US009528337B2

(12) United States Patent
Iondov

(10) Patent No.: US 9,528,337 B2
(45) Date of Patent: Dec. 27, 2016

(54) UP-HOLE BUSHING AND CORE BARREL HEAD ASSEMBLY COMPRISING SAME

(71) Applicant: Longyear TM, Inc., South Jordan, UT (US)

(72) Inventor: George Iondov, Mississauga (CA)

(73) Assignee: LONGYEAR TM, INC., Salt Lake City, UT (US)

( * ) Notice: Subject to any disclaimer, the term of this patent is extended or adjusted under 35 U.S.C. 154(b) by 538 days.

(21) Appl. No.: 13/803,820

(22) Filed: Mar. 14, 2013

(65) Prior Publication Data

US 2013/0192901 A1 Aug. 1, 2013

Related U.S. Application Data

(63) Continuation-in-part of application No. 12/898,878, filed on Oct. 6, 2010, now Pat. No. 8,794,355.

(60) Provisional application No. 61/249,544, filed on Oct. 7, 2009, provisional application No. 61/287,106, filed on Dec. 16, 2009.

(51) Int. Cl.
*E21B 25/02* (2006.01)
*E21B 34/00* (2006.01)

(52) U.S. Cl.
CPC ..... *E21B 25/02* (2013.01); *E21B 34/00* (2013.01)

(58) Field of Classification Search
CPC ..... E21B 25/02; E21B 25/00; E21B 34/00; E21B 34/06; E21B 34/102
See application file for complete search history.

(56) References Cited

U.S. PATENT DOCUMENTS

| | | | |
|---|---|---|---|
| 1,643,730 | A | 9/1927 | Wild |
| 2,184,361 | A | 12/1939 | Noble |
| 2,510,865 | A | 6/1950 | Cooper |
| 2,521,886 | A | 9/1950 | Walker |
| 2,829,868 | A | 4/1958 | Pickard |

(Continued)

FOREIGN PATENT DOCUMENTS

| | | |
|---|---|---|
| AU | 2008222974 | 3/2008 |
| AU | 2008222974 A1 | 9/2008 |

(Continued)

OTHER PUBLICATIONS

U.S. Appl. No. 60/892,848, filed Mar. 3, 2007, Drenth.

(Continued)

*Primary Examiner* — Elizabeth Gitlin
(74) *Attorney, Agent, or Firm* — Ballard Spahr LLP

(57) ABSTRACT

A bushing for positioning within a core barrel assembly during an up-hole drilling operation. The bushing has a wall with an inner surface and an outer surface. The inner surface defines an inlet, an outlet, and a central bore of the bushing. The central bore surrounds a longitudinal axis of the bushing and extends between the inlet and the outlet. The outer surface has a first portion positioned proximate the inlet and a second portion positioned proximate the outlet. The first portion of the outer surface of the wall projects outwardly from the second portion of the outer surface relative to the longitudinal axis of the bushing such that the first portion of the outer surface defines opposed first and second shoulder surfaces extending substantially perpendicularly relative to the longitudinal axis. Core barrel head assemblies including such bushings are also described.

19 Claims, 14 Drawing Sheets

(56) References Cited

U.S. PATENT DOCUMENTS

| | | | | |
|---|---|---|---|---|
| 3,092,191 | A | 6/1963 | Austin | |
| 3,103,981 | A | 9/1963 | Harper | |
| 3,115,188 | A | 12/1963 | Cochran | |
| 3,120,283 | A | 2/1964 | Braun | |
| 3,126,064 | A | 3/1964 | Miller | |
| 3,225,845 | A | 12/1965 | Koontz | |
| 3,305,033 | A | 2/1967 | Pickard | |
| 3,333,647 | A | 8/1967 | Karich | |
| 3,340,939 | A * | 9/1967 | Lindelof | 175/246 |
| 3,004,614 | A | 10/1967 | De Witt | |
| 3,346,059 | A | 10/1967 | Svendsen | |
| 3,363,705 | A | 1/1968 | Jensen | |
| 3,461,981 | A | 8/1969 | Casper | |
| 3,494,418 | A | 2/1970 | Young | |
| 3,543,870 | A | 12/1970 | Martinsen | |
| 3,667,558 | A | 6/1972 | Lambot | |
| 3,930,679 | A | 1/1976 | Anderson et al. | |
| 3,977,482 | A | 8/1976 | Reed et al. | |
| 3,990,524 | A | 11/1976 | Sweeney | |
| 4,418,770 | A | 12/1983 | Lambot | |
| 4,466,497 | A | 8/1984 | Soinski et al. | |
| 4,664,204 | A | 5/1987 | Nenkov et al. | |
| 4,800,969 | A | 1/1989 | Thompson | |
| 4,823,872 | A | 4/1989 | Hopmann | |
| 4,832,138 | A | 5/1989 | Hallez | |
| 4,834,198 | A | 5/1989 | Thompson | |
| 4,930,587 | A | 6/1990 | Young et al. | |
| 5,020,612 | A | 6/1991 | Williams | |
| 5,253,720 | A | 10/1993 | Radford et al. | |
| 5,267,620 | A | 12/1993 | Lee | |
| 5,311,950 | A | 5/1994 | Spektor | |
| 5,325,930 | A | 7/1994 | Harrison | |
| 5,339,915 | A * | 8/1994 | Laporte et al. | 175/244 |
| 5,662,182 | A | 9/1997 | McLeod et al. | |
| 5,785,134 | A | 7/1998 | McLeod et al. | |
| 5,799,742 | A | 9/1998 | Soinski et al. | |
| 5,934,393 | A * | 8/1999 | Marshall | 175/236 |
| 5,992,543 | A | 11/1999 | Soinski et al. | |
| D420,013 | S | 2/2000 | Warren et al. | |
| 6,019,181 | A | 2/2000 | Soinski et al. | |
| 6,029,758 | A * | 2/2000 | Novacovicci et al. | 175/234 |
| 6,039,129 | A | 3/2000 | McLeod | |
| 6,059,053 | A | 5/2000 | McLeod | |
| 6,089,335 | A | 7/2000 | Able | |
| 6,371,205 | B1 | 4/2002 | Langan et al. | |
| 6,425,449 | B1 * | 7/2002 | Marshall | 175/236 |
| 6,564,885 | B2 | 5/2003 | Attwater | |
| 6,644,424 | B1 | 11/2003 | Fanuel | |
| 6,708,784 | B1 | 3/2004 | Borg | |
| 7,296,638 | B2 | 11/2007 | Beach et al. | |
| 7,314,101 | B2 | 1/2008 | Beach | |
| 7,363,967 | B2 | 4/2008 | Burris, II et al. | |
| 7,730,965 | B2 | 6/2010 | Jordan et al. | |
| D622,293 | S | 8/2010 | Drenth et al. | |
| D622,294 | S | 8/2010 | Drenth et al. | |
| D622,741 | S | 8/2010 | Drenth et al. | |
| D624,564 | S | 9/2010 | Drenth et al. | |
| 7,841,400 | B2 | 11/2010 | Wells et al. | |
| D632,309 | S | 2/2011 | Coyle, Jr. | |
| 7,900,716 | B2 | 3/2011 | Ibrahim et al. | |
| 7,967,085 | B2 | 6/2011 | Drenth | |
| 8,261,857 | B2 | 9/2012 | Able et al. | |
| 8,333,255 | B2 | 12/2012 | Drenth | |
| 8,485,280 | B2 | 7/2013 | Drenth et al. | |
| 8,770,322 | B2 | 7/2014 | Drenth et al. | |
| 2004/0216927 | A1 | 11/2004 | Beach | |
| 2005/0034894 | A1 | 2/2005 | Beach et al. | |
| 2005/0241825 | A1 | 11/2005 | Burris et al. | |
| 2006/0029758 | A1 | 2/2006 | Kim | |
| 2009/0032256 | A1 | 2/2009 | Sun et al. | |
| 2009/0173542 | A1 | 7/2009 | Ibrahim et al. | |
| 2009/0260882 | A1 | 10/2009 | Drenth | |
| 2009/0283328 | A1 | 11/2009 | Drivdahl et al. | |
| 2011/0079435 | A1 | 4/2011 | Drenth et al. | |
| 2011/0079436 | A1 | 4/2011 | Drenth et al. | |
| 2012/0261132 | A1 | 10/2012 | Wilson | |
| 2013/0105227 | A1 | 5/2013 | Drenth | |
| 2013/0313024 | A1 | 11/2013 | Drenth et al. | |

FOREIGN PATENT DOCUMENTS

| | | | |
|---|---|---|---|
| AU | 2010303446 | | 10/2010 |
| AU | 2010339878 | | 12/2010 |
| AU | 2010303446 | A1 | 5/2012 |
| AU | 2010339878 | A1 | 7/2012 |
| BR | 11 2012 008034 2 | | 10/2010 |
| BR | 11 2012 014787 0 | | 12/2010 |
| BR | 11 2012 008034 2 | | 4/2011 |
| BR | 11 2012 0147870 | | 7/2011 |
| CA | 2679933 | | 3/2008 |
| CA | 2679933 | A1 | 9/2008 |
| CA | 2776923 | | 10/2010 |
| CA | 2784532 | | 12/2010 |
| CA | 2776923 | A1 | 4/2011 |
| CA | 2784532 | A1 | 7/2011 |
| CL | 2012-00884 | | 10/2010 |
| CL | 2012-01618 | | 12/2010 |
| CL | 88412 | | 4/2011 |
| CL | 2012-01618 | | 7/2011 |
| CN | 200880007004.5 | | 3/2008 |
| CN | 101675205 | A | 3/2010 |
| CN | 201080055434.1 | | 10/2010 |
| CN | 201080057031.0 | | 12/2010 |
| CN | 10278224 | | 4/2011 |
| CN | 102791954 | A | 11/2012 |
| EP | 1757770 | A1 | 2/2007 |
| EP | 08731246.8 | | 3/2008 |
| EP | 2132395 | A1 | 12/2009 |
| EP | 10822658 | | 10/2010 |
| EP | 10842597.6 | | 12/2010 |
| EP | 2486223 | A2 | 8/2012 |
| EP | 2513413 | A2 | 10/2012 |
| GB | 992246 | A | 5/1965 |
| NZ | 599635 | | 10/2010 |
| NZ | 600697 | | 12/2010 |
| NZ | 600697 | | 7/2011 |
| NZ | 599635 | A | 9/2013 |
| PE | 446.2012 | | 10/2010 |
| PE | 823.2012 | | 12/2010 |
| PE | 446.2012 | | 4/2011 |
| PE | 823.2012 | | 7/2011 |
| WO | WO-95/03475 | A1 | 2/1995 |
| WO | WO-03/038232 | A1 | 5/2003 |
| WO | PCT/US2008/055656 | | 3/2008 |
| WO | WO 2008/109522 | | 9/2008 |
| WO | WO-2008/109522 | A1 | 9/2008 |
| WO | WO-2009/108113 | A1 | 9/2009 |
| WO | WO-2010/096860 | A1 | 9/2010 |
| WO | PCT/US2010/051747 | | 10/2010 |
| WO | PCT/US2010/060744 | | 12/2010 |
| WO | WO 2011/044314 | | 4/2011 |
| WO | WO-2011/044314 | A2 | 4/2011 |
| WO | WO 2011/084589 | | 7/2011 |
| WO | WO-2011/084589 | A2 | 7/2011 |
| WO | 2014023405 | | 3/2014 |
| WO | PCT/US2014/023405 | | 3/2014 |
| ZA | 2009/05921 | | 3/2008 |
| ZA | 2009/05921 | | 9/2008 |
| ZA | 2012/03285 | | 10/2010 |
| ZA | 2012/05268 | | 12/2010 |
| ZA | 2012/03285 | | 4/2011 |
| ZA | 2012/05268 | | 7/2011 |

OTHER PUBLICATIONS

U.S. Pat. No. 8,333,255, filed on Dec. 18, 2012, Drenth.
US2013/0105227, filed on May 2, 2013, Drenth.
U.S. Appl. No. 61/249,544, filed Oct. 7, 2009, Drenth.
U.S. Appl. No. 61/287,106, filed Dec. 16, 2009, Drenth.
US2011/0079435, filed on Apr. 7, 2011, Drenth.
U.S. Pat. 8,485,280, filed on Jul. 16, 2013, Drenth.
US2013/0313024, filed on Nov. 28, 2013, Drenth.
U.S. Appl. No. 14/193,136, filed Feb. 28, 2014, Muntz.

(56) References Cited

OTHER PUBLICATIONS

Non-Final Office Action issued by the U.S. Patent & Trademark Office on Jun. 5, 2015 for U.S. Appl. No. 13/943,460, filed Jul. 16, 2013 and published as US-2013-0313024-A1 on Nov. 28, 2013 (Inventor—Drenth, et al. // Applicant—Boart Longyear) (7 pages).
Extended European Search Report issued by the European Patent Office on Jun. 26, 2015 for application EP 08731246.8, filed on Mar. 3, 2008 (Applicant—Boart Longyear // Inventor—Drenth) (5 pages).
Ex Parte Quayle Action issued on Feb. 12, 2016 for U.S. Appl. No. 14/193,136, filed Feb. 28, 2014 and published as US-2014-0174828 on Jun. 26, 2014 (Applicant—Longyear TM, Inc. // Inventor—Muntz, et al.) (6 pages).
Response to Ex Parte Quayle Action filed on Mar. 24, 2016 for U.S. Appl. No. 14/193,136, filed Feb. 28, 2014 and published as US-2014-0174828 on Jun. 26, 2014 (Applicant—Longyear TM, Inc. // Inventor—Muntz, et al.) (5 pages).
Notice of Allowance issued on Apr. 7, 2016 for U.S. Appl. No. 14/193,136, filed Feb. 28, 2014 and published as US-2014-0174828 on Jun. 26, 2014 (Applicant—Longyear TM, Inc. // Inventor—Muntz, et al.) (5 pages).
Office Action issued on Feb. 15, 2016 by the Canadian Intellectual Property Office for application 2876377, filed on Jan. 6, 2015 (Inventor—Drenth // Applicant—Longyear TM, Inc.) (5 pages).
Final Office Action issued on Nov. 17, 2015 for U.S. Appl. No. 13/717,421, filed Dec. 17, 2012 and published as US-2013-0105227-A1 on May 2, 2013 (Applicant—Boart Longyear // Inventor—Drenth) (7 pages).
Response to Final Office Action filed on Feb. 17, 2016 for U.S. Appl. No. 13/717,421, filed Dec. 17, 2012 and published as US-2013-0105227-A1 on May 2, 2013 (Applicant—Boart Longyear // Inventor—Drenth) (12 pages).
Notice of Allowance issued on Mar. 28, 2016 for U.S. Appl. No. 13/717,421, filed Dec. 17, 2012 and published as US-2013-0105227-A1 on May 2, 2013 (Applicant—Boart Longyear // Inventor—Drenth) (6 pages).
U.S. Appl. No. 14/193,136, Muntz et al.
International Preliminary Report on Patentability issued Sep. 8, 2009 for International Patent Application PCT/US2008/055656, which was filed on Mar. 3, 2008 and published as WO 2008/109522 on Sep. 12, 2008 (Inventor—Drenth; Applicant—Boart Longyear) (pp. 1-4).
International Search Report and Written Opinion issued Aug. 8, 2008 for International Patent Application PCT/US2008/055656, which was filed on Mar. 3, 2008 and published as WO 2008/109522 on Sep. 12, 2008 (Inventor—Drenth; Applicant—Boart Longyear) (pp. 1-5).
Non-Final Office Action issued Aug. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-8).
Amendment "A" and Response to Office Action filed Oct. 27, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-28).
Applicant Initiated Interview Summary issued Nov. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Final Office Action issued Apr. 5, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-9).
Amendment and Response to Final Office Action filed Jun. 14, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-21).
Applicant Initiated Interview Summary issued Jun. 20, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Notice of Allowance issued Oct. 3, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-5).
Notice of Allowance issued Nov. 6, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-2).
Issue Notification issued Nov. 28, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-1).
Preliminary Amendment filed Apr. 23, 2013 for U.S. Appl. No. 13/717,421, filed Dec. 17, 2012 and published as U.S. 2013/0105227 on May 2, 2013 (Inventor—Drenth; Applicant—Longyear TM, Inc.) (pp. 1-3).
International Preliminary Report on Patentability issued Apr. 11, 2012 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-5).
International Search Report and Written Opinion issued Jun. 10, 2011 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-7).
Preliminary Amendment filed Sep. 27, 2011 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Restriction Requirement issued Dec. 21, 2012 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-6).
Response to Restriction Requirement filed Jan. 22, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Non-Final Office Action issued Apr. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Non-Final Office Action filed Jul. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-17).
Final Office Action issued Sep. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Final Office Action filed Jan. 27, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-14).
Notice of Allowance issued Mar. 31, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-5).
International Preliminary Report on Patentability issued Jun. 19, 2012 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-4).
International Search Report and Written Opinion issued Jul. 27, 2011 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-6).

(56) References Cited

OTHER PUBLICATIONS

Non-Final Office Action issued Aug. 6, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Amendment in Response to Non-Final Office Action filed Nov. 5, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-13).
Final Office Action issued Dec. 21, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-10).
Amendment in Response to Final Office Action filed Feb. 21, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-16).
Supplemental Amendment filed Mar. 1, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Notice of Allowance, Examiner Interview Summary, and Examiner's Amendment filed Mar. 15, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-8).
Issue Notification issued Jun. 26, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-1).
Notice of Allowance and Examiner's Amendment issued Aug. 1, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-7).
Notice of Allowance issued Sep. 20, 2011 for U.S. Appl. No. 29/383,554, which was filed on Jan. 19, 2011 and issued as U.S. Patent D649,167 (Inventor—Drenth; Applicant—Longyear TM, Inc.) (pp. 1-7).
Notice of Allowance issued Oct. 17, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-2).
Issue Notification issued Nov. 2, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-1).
Notice of Allowance and Examiner's Amendment issued Aug. 25, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-8).
Issue Notification issued Oct. 19, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-1).
Notice of Allowance issued Aug. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-4).
Issue Notification issued Oct. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-1).
Notice of Allowance issued Apr. 6, 2011 for U.S. Appl. No. 29/383,340, filed Jan. 14, 2011 and issued as U.S. Pat. No. D644,668 on Sep. 6, 2011 (Inventor—Drenth; Applicant—Longyear TM, Inc.) (pp. 1-7).
Supplemental Notice of Allowance issued Jul. 11, 2011 for U.S. Appl. No. 29/383,340, filed Jan. 14, 2011 and issued as U.S. Pat. No. D644,668 on Sep. 6, 2011 (Inventor—Drenth; Applicant—Longyear TM, Inc.) (pp. 1-2).
Issue Notification issued Aug. 17, 2011 for U.S. Appl. No. 29/383,340, filed Jan. 14, 2011 and issued as U.S. Pat. No. D644,668 on Sep. 6, 2011 Inventor—Drenth; Applicant—Longyear TM, Inc.) (pp. 1-1).
Notice of Allowance and Examiner's Amendment issued May 26, 2011 for U.S. Appl. No. 29/383,623, filed Jan. 20, 2011 and issued as U.S. Pat. No. D647,540 on Oct. 25, 2011 (Inventor—Drenth; Applicant—Longyear TM, Inc.) (pp. 1-7).
Notice of Allowance issued Aug. 4, 2011 for U.S. Appl. No. 29/383,623, filed Jan. 20, 2011 and issued as U.S. Pat. No. D647,540 on Oct. 25, 2011 (Inventor—Drenth; Applicant—Longyear TM, Inc.) (pp. 1-7).
Issue Notification issued Oct. 5, 2011 for U.S. Appl. No. 29/383,623, filed Jan. 20, 2011 and issued as U.S. Pat. No. D647,540 on Oct. 25, 2011 (Inventor—Drenth; Applicant—Longyear TM, Inc.) (pp. 1-1).
International Search Report and Written Opinion issued Jul. 27, 2011 for International Patent Application PCT/US2010/060742, which was filed on Dec. 16, 2010 and published as WO 2011/084587 on Jul. 14, 2011 (Inventor—Drenth; Applicant—Longyear TM, Inc.) (pp. 1-6).
Notice of Allowance issued Apr. 6, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-7).
Supplemental Notice of Allowance issued Jul. 11, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-2).
Issue Notification issued Aug. 3, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-1).
Notice of Allowance issued Apr. 8, 2011 for U.S. Appl. No. 29/383,572, filed Jan. 19, 2011 and issued as U.S. Pat. No. D643,443 on Aug. 16, 2011 (Inventor—Drenth; Applicant—Longyear TM, Inc.) (pp. 1-7).
Issue Notification issued Jul. 27, 2011 for U.S. Appl. No. 29/383,572, filed Jan. 19, 2011 and issued as U.S. Pat. No. D643,443 on Aug. 16, 2011 (Inventor—Drenth; Applicant—Longyear TM, Inc.) (pp. 1-1).
Non-Final Office Action issued Jan. 6, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-13).
Notice of Allowance issued Feb. 25, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-7).
Issue Notification issued Jun. 28, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-1).
International Search Report and Written Opinion issued Oct. 28, 2009 for International Patent Application PCT/US2009/041435, which was filed on Apr. 22, 2009 and published as WO 2009/132125 on Oct. 29, 2009 (Inventor—Drenth; Applicant—Longyear TM, Inc.) (pp. 1-6).
International Search Report and the Written Opinion of the International Search Authority for Application No. PCT/US2014/023405 (mailed Jun. 20, 2014).
First Office Action issued on Jul. 20, 2016 by the SIPO for application CN 2014800210968, filed on Mar. 11, 2014 and published as CN 105209712 on Dec. 30, 2015 (Applicant—Longyear TM, Inc.//Inventor—londov) (English Translation—9 pages//Original—8 pages).
First Office Action issued on Aug. 31, 2016 by the SIPO for application CN 201410669852.X, filed on Nov. 20, 2014 and published as CN 104563933 on Apr. 29, 2015 (Applicant—Longyear TM, Inc.//Inventor—Drenth) (English Translation—4 pages//Original—5 pages).
Non-Final Office Action issued on Sep. 23, 2016 for U.S. Appl. No. 14/500,012, filed Sep. 29, 2014 and published as US US-2015-

(56) References Cited

OTHER PUBLICATIONS

0014064-A1 on Jan. 15, 2015 (Applicant—Boart Longyear TM, Inc.//Inventor—Drenth) (6 pages).

* cited by examiner

UP-HOLE BUSHING AND CORE BARREL HEAD ASSEMBLY COMPRISING SAME

CROSS-REFERENCE TO RELATED APPLICATIONS

This application is a continuation-in-part of U.S. patent application Ser. No. 12/898,878, filed Oct. 6, 2010, entitled "Driven Latch Mechanism." This application also claims priority to and the benefit of U.S. Provisional Application No. 61/249,544, filed Oct. 7, 2009, entitled "Driven Latch Mechanism," and U.S. Provisional Application No. 61/287,106, filed Dec. 16, 2009, entitled "Driven Latch Mechanism for High Productivity Core Drilling." The contents of the above-referenced patent applications are hereby incorporated by reference in their entirety.

FIELD

This invention relates generally to drilling devices and methods that may be used to drill geological and/or man-made formations. In particular, the invention relates to bushings used during up-hole drilling operations and core barrel head assemblies incorporated such bushings.

BACKGROUND

Exploration drilling can include retrieving a sample of a desired material (core sample) from a formation. Wireline drilling systems are one common type of drilling system for retrieving a core sample. In wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string. The core drill bit is rotated, pushed, and/or vibrated into the formation, thereby causing a sample of the desired material to enter into the core barrel assembly. Once the core sample is obtained, the core barrel assembly is retrieved from the drill string using a wireline. The core sample can then be removed from the core barrel assembly.

Core barrel assemblies commonly include a core barrel for receiving the core, and a head assembly for attaching to the wireline. Typically, the core barrel assembly is lowered into the drill string until the core barrel reaches a portion the outer tube or distal most drill rod. At this point a latch on the head assembly is deployed to restrict the movement of the core barrel assembly with respect to the drill rod. Once latched, the core barrel assembly is then advanced into the formation along with the drill rod, causing material to fill the core barrel.

During up-hole drilling operations, water typically builds up above the core barrel assembly. Drill operators must drain the built-up water before the core barrel assembly can be removed. The drainage of this built-up water causes delays in drilling operations and reduces drilling efficiency.

Thus, there is a need in the pertinent art for devices, systems, and methods that improve the drainage of water from a wire line string and improve drilling efficiency during up-hole drilling operations.

SUMMARY

One or more implementations of the present invention overcome one or more problems in the art with drilling tools, systems, and methods for effectively and efficiently latching a core barrel assembly to a drill string. For example, one or more implementations of the present invention include a core barrel assembly having a driven latch mechanism that can reliably lock the core barrel assembly in a fixed axial position within a drill string. Additionally, the drive latch mechanism can reduce or eliminate wear between mating components of the core barrel assembly and the drill string. In particular, the driven latch mechanism can rotationally lock the core barrel assembly relative to the drill string, thereby reducing or eliminating sliding contact (and associated wear) between mating components of the core barrel assembly and the drill string.

For example, one implementation of a core barrel head assembly includes a sleeve having a plurality of latch openings extending there through. The core barrel head assembly can also include a driving member positioned at least partially within the sleeve. The driving member can include a plurality of planar driving surfaces. Additionally, the core barrel head assembly can include a plurality of wedge members positioned on or against the plurality of planar driving surfaces. The plurality of wedge members can extend within the plurality of latch openings. The driving member can wedge the plurality of wedge members between an inner surface of the drill string and the plurality of planar driving surfaces, thereby preventing rotation of the core barrel head assembly relative to the drill string.

Additionally, another implementation of a core barrel head assembly can include a sleeve, an upper latch body moveably coupled to the sleeve, and a driving member positioned at least partially within the sleeve. The core barrel head assembly can also include a landing member positioned at least partially within the upper latch body. Further, the core barrel head assembly can include a plurality of wedge members positioned on the driving member. Axial movement of the driving member relative to the plurality of wedge members can move the plurality of wedge members radially relative to the sleeve between a latched position and a released position. Still further the core barrel head assembly can include a plurality of braking elements positioned on the landing member. Axial movement of the landing member relative to the plurality of braking elements can move the plurality of braking elements radially relative to the upper latch body between a retracted position and an extended position.

Furthermore, an implementation of a drilling system for retrieving a core sample can include a drill rod including a first annular recess extending into an inner diameter of the drill rod. Also, the drilling system can include a core barrel assembly adapted to be inserted within the drill rod. Additionally, the drilling system can include a driven latch mechanism positioned within the core barrel assembly. The driven latch mechanism can include a driving member including a plurality of planar driving surfaces, and a plurality of wedge members. Axial displacement of the driving member relative to the plurality of wedge members can push or force the plurality of wedge into the first annular recess of the drill rod, thereby axially locking the core barrel head assembly relative to the drill rod. Furthermore, rotation of the drill rod can cause the plurality of wedge members to rotationally lock the core barrel assembly relative to the drill rod.

In addition to the foregoing, a method of drilling can involve inserting a core barrel assembly within a drill string. The core barrel assembly can comprise a driven latch mechanism including a plurality of wedge members positioned on a plurality of planar driving surfaces. The method can further involve moving the core barrel assembly within the drill string to a drilling position. The method can also involve deploying the plurality of wedge members into an annular groove of the drill string. Additionally, the method can involve rotating the drill string thereby causing the plurality of wedge members to wedge between the inner diameter of the drill string and the plurality of planar driving surfaces. The wedging of the plurality of wedge members can rotationally lock the core barrel assembly relative to the drill string.

Also described herein is a bushing for positioning within a core barrel head assembly during an up-hole drilling operation. The bushing has a longitudinal axis and a wall having an inner surface and an outer surface. The inner surface of the bushing can define an inlet, an outlet, and a central bore of the bushing. The central bore of the bushing can surround the longitudinal axis of the bushing and extend between the inlet and the outlet of the bushing. The outer surface of the bushing can have a first portion positioned proximate the inlet of the bushing and a second portion positioned proximate the outlet of the bushing. The first portion of the outer surface can project outwardly from the second portion of the outer surface relative to the longitudinal axis of the bushing such that the first portion of the outer surface defines opposed first and second shoulder surfaces extending substantially perpendicularly relative to the longitudinal axis of the bushing. Optionally, the inner surface of the bushing can define a projection positioned between the inlet and the outlet of the bushing within the central bore of the bushing.

A core barrel head assembly having a longitudinal axis can be provided with a sleeve, a lower latch body, a piston, and an up-hole bushing as described above. The sleeve can define at least one fluid port and have an inner surface. The inner surface of the sleeve can have an inner projection. The lower latch body can be removably coupled to the sleeve. The piston can have an end portion and an elongate shaft portion. The piston can be configured for axial movement relative to the longitudinal axis of the core barrel head assembly. The bushing can be positioned within the sleeve. The longitudinal axis of the bushing can be aligned with the longitudinal axis of the core barrel head assembly. At least a portion of the outer surface of the bushing can be configured for engagement with the inner surface of the sleeve. The first shoulder surface of the bushing can be configured for engagement with the lower latch body, while the second shoulder surface of the bushing can be configured for engagement with the inner projection of the sleeve. The central bore of the bushing can be configured to receive at least a portion of the piston such that axial movement of the piston relative to the longitudinal axis of the core barrel assembly selectively controls fluid flow through the bushing.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein.

Figure 12:
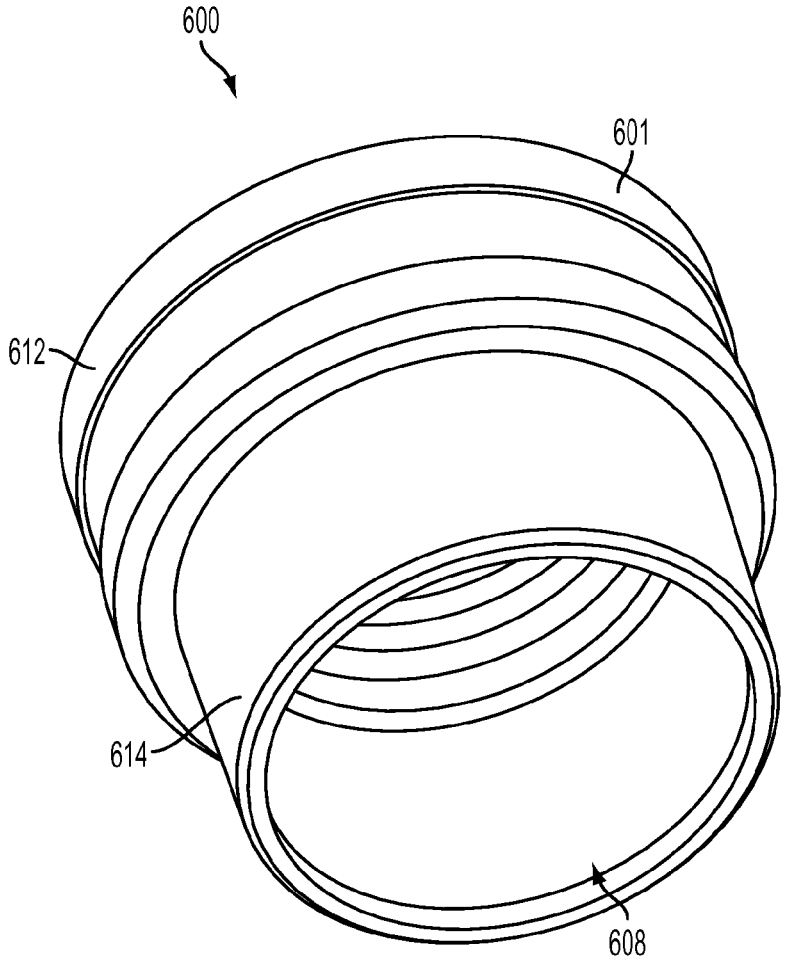
Figure 13:
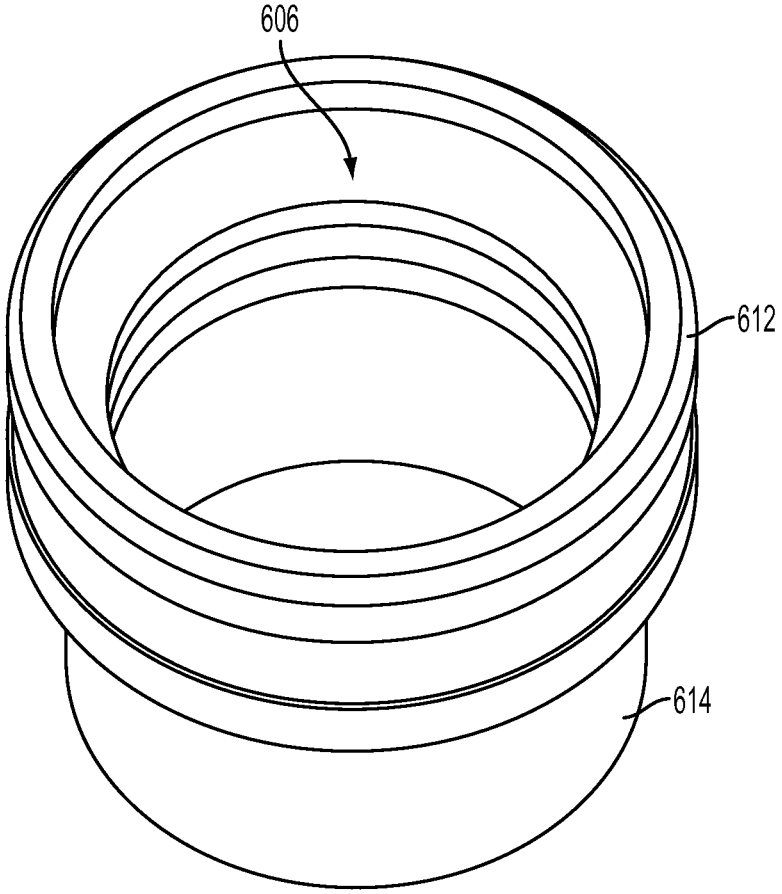
Figure 14:
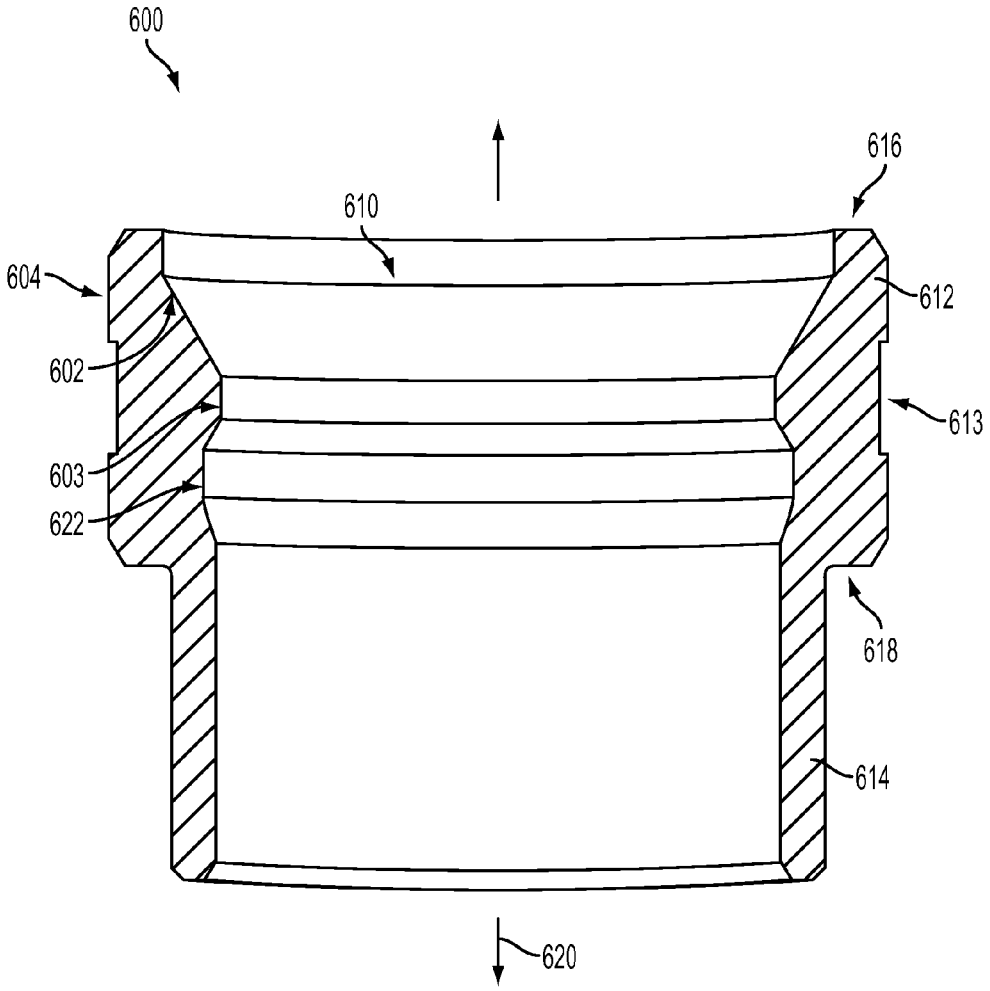

FIGS. 12-14 depict an exemplary up-hole bushing as described herein. FIG. 12 is a bottom perspective view of the up-hole bushing. FIG. 13 is a top perspective view of the up-hole bushing of FIG. 13. FIG. 14 is a cross-sectional view of the up-hole bushing of FIG. 13

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a wood layer" can include two or more such wood layers unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Core Barrel Head Assemblies Having Driven Latch Mechanisms

Implementations of the present invention are directed toward drilling tools, systems, and methods for effectively and efficiently latching a core barrel assembly to a drill string. For example, one or more implementations of the present invention include a core barrel assembly having a driven latch mechanism that can reliably lock the core barrel assembly in a fixed axial position within a drill string. Additionally, the drive latch mechanism can reduce or eliminate wear between mating components of the core barrel assembly and the drill string. In particular, the driven latch mechanism can rotationally lock the core barrel assembly relative to the drill string, thereby reducing or eliminating sliding contact (and associated wear) between mating components of the core barrel assembly and the drill string.

Assemblies, systems, and methods of one or more implementations can include or make use of a driven latch mechanism for securing a core barrel assembly at a desired position within a tubular member, such as a drill rod of a drill string. The driven latch mechanism can include a plurality of wedge members, and a driving member having a plurality of driving surfaces. The driving surfaces drive the wedge members to interact with an inner surface of a drill rod to latch or lock the core barrel assembly in a desired position within the drill string. Thereafter, rotation of the drill rod can cause the wedge members to wedge between the drive surfaces and the inner diameter of the drill rod, thereby rotationally locking the core barrel relative to the drill string.

Furthermore, one or more implementations provide a driven latch mechanism that can maintain a deployed or latched condition despite vibration and inertial loading of mating head assembly components due to drilling operations or abnormal drill string movement. Also, one or more implementations can provide a latch mechanism that does not disengage or retract unintentionally, and thus prevents the core barrel inner tube assembly from rising from the drilling position in a down-angled hole, or falling unannounced from an up-angled drill hole.

Additionally, one or more implementations can include a braking mechanism that can prevent the core barrel assembly from unintentionally sliding out of the drill string in an uncontrolled and possibly unsafe manner. In particular, the braking mechanism can include a landing member and a plurality of brake elements. The landing member can push the plurality of brake elements against an inner surface of a drill string, allowing the braking mechanism to stop axial movement of the core barrel assembly within or relative to the drill string. In one or more implementations, the landing member can include a taper such that varying the axial position of the landing member varies the radial position of the brake elements, thereby allowing the brake elements to maintain engagement with a variable inner diameter of a drill string.

For ease of reference, the driven latch mechanism shall be described with generally planar driving surfaces and spherical or ball-shaped wedge members. It will be appreciated that the driving members can have any number of driving surfaces with any desired shape, including, but not limited to, convex, concave, patterned or any other shape or configuration capable of wedging a wedge member as desired. Further, the wedge members can have any shape and configuration possible. In at least one example, a universal-type joint can replace the generally spherical wedge members, tapered planar drive surfaces, and accompanying sockets. Thus, the present invention can be embodied in other specific forms without departing from its spirit or essential characteristics. The described embodiments are to be considered in all respects only as illustrative and not restrictive.

In other words, the following description supplies specific details in order to provide a thorough understanding of the invention. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques. For example, while the description below focuses on core sample operations, the apparatus and associated methods could be equally applied in other drilling processes, such as in conventional borehole drilling, and may be used with any number or varieties of drilling systems, such as rotary drill systems, percussive drill systems, etc.

Further, while the Figures show six wedge members in the latching mechanism, any number of latches may be used. In at least one example, five ball-shaped wedge members will be used in a driven latch mechanism. Similarly, the precise configuration of components as illustrated may be modified or rearranged as desired by one of ordinary skill. Additionally, while the illustrated implementations specifically discuss a wireline system, any retrieval system may be used, such as a drill string.

Figure 1:
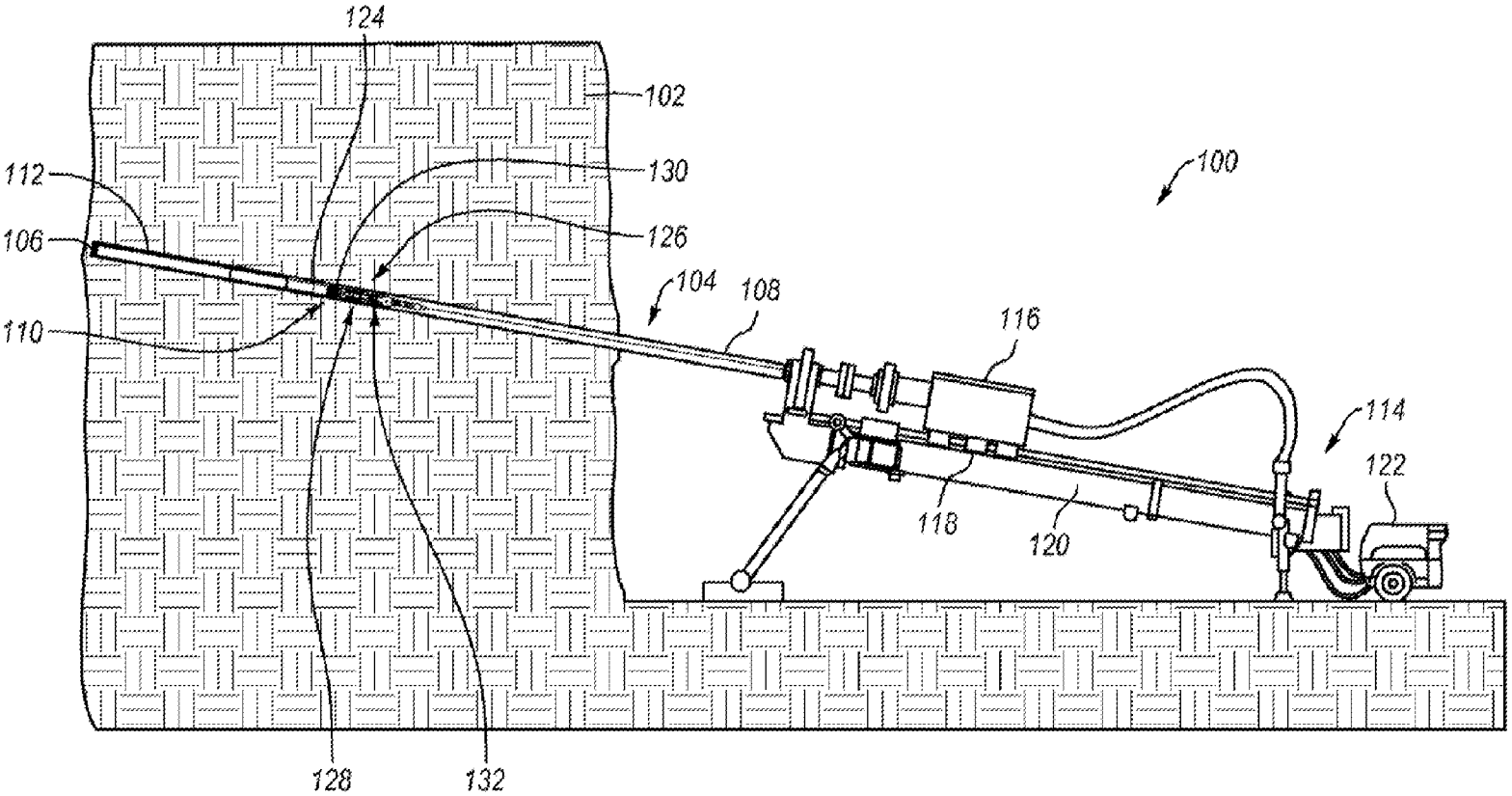
FIG. 1 illustrates a schematic view a drilling system including a core barrel assembly having a driven latch mechanism in accordance with an implementation of the present invention.

As shown in FIG. 1, a drilling system 100 may be used to retrieve a core sample from a formation 102. The drilling system 100 may include a drill string 104 that may include a drill bit 106 (for example, an open-faced drill bit or other type of drill bit) and/or one or more drill rods 108. The drilling system 100 may also include an in-hole assembly, such as a core barrel assembly 110. The core barrel assembly 110 can include a driven latch mechanism configured to lock the core barrel assembly at least partially within a distal drill rod or outer tube 112, as explained in greater detail below. As used herein the terms "down" and "distal end" refer to the end of the drill string 104 including the drill bit 106, whether the drill string be oriented horizontally, at an upward angle, or a downward angle relative to the horizontal. While the terms "up" or "proximal" refer to the end of the drill string 104 opposite the drill bit 106.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a rotary drill head 116, a sled assembly 118, a slide frame 120 and/or a drive assembly 122. The drill head 116 may be coupled to the drill string 104, and can allow the rotary drill head 116 to rotate the drill bit 106, the core barrel assembly 110, the drill rods 108 and/or other portions of the drill string 104. If desired, the rotary drill head 116 may be configured to vary the speed and/or direction that it rotates these components. The drive assembly 122 may be configured to move the sled assembly 118 relative to the slide frame 120. As the sled assembly 118 moves relative to the slide frame 120, the sled assembly 118 may provide a force against the rotary drill head 116, which may push the drill bit 106, the core barrel assembly 110, the drill rods 108 and/or other portions of the drill string 104 further into the formation 102, for example, while they are being rotated.

It will be appreciated, however, that the drill rig 114 does not require a rotary drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102. For example, sonic, percussive, or down hole motors may be used.

The core barrel assembly 110 may include an inner tube or core barrel 124, and a head assembly 126. The head assembly 126 can include a driven latch mechanism 128. As explained in greater detail below, the driven latch mechanism 128 can lock the core barrel 124 within the drill string 104, and particularly to the outer tube 112. Furthermore, the driven latch mechanism 128 can rotationally lock the core barrel assembly 110 to the drill string 104 thereby preventing wear due to rotation or sliding between the mating components of the driven latch mechanism 128 and the drill string 104.

Once the core barrel 124 is locked to the outer tube 112 via the driven latch mechanism 128, the drill bit 106, the core barrel assembly 110, the drill rods 108 and/or other portions of the drill string 104 may be rotated and/or pushed into the formation 102 to allow a core sample to be collected within the core barrel 124. After the core sample is collected, the core barrel assembly 110 may be unlocked from the outer tube 112 and drill string 104. The core barrel assembly 110 may then be retrieved, for instance using a wireline retrieval system, while the drill bit 106, the outer tube 112, one or more of the drill rods 108 and/or other portions of the drill string 104 remain within the borehole.

The core sample may be removed from core barrel 124 of the retrieved core barrel assembly 110. After the core sample is removed, the core barrel assembly 110 may be sent back and locked to the outer tube 112. With the core barrel assembly 110 once again locked to the outer tube 112, the drill bit 106, the core barrel assembly 110, the drill rods 108 and/or other portions of the drill string 104 may be rotated and/or pushed further into the formation 102 to allow another core sample to be collected within the core barrel 124. The core barrel assembly 110 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

During some drilling processes, hydraulic pressure may be used to pump and/or advance core barrel assembly 110 within the drill string 104 to the outer tube 112. In particular, hydraulic pressure may be used to pump the core barrel assembly 110 within the drill string 104 to the outer tube 112 when the drill string 104 is oriented upwardly relative to the horizontal (as shown in FIG. 1), is oriented generally horizontally, or oriented with a slight downward angle relative to the horizontal. To allow for the core barrel assembly 110 to be pumped to the outer tube 112, the core barrel assembly 110 can further include a seal 130 configured to form a seal with one or more portions of the drill string 104, such as, inner walls of the drill rods 108. The seal 130 may be further configured as a pump-in seal, such that pressurized fluid pumped into the drill string 104 behind the seal 130 may cause hydraulic pressure behind the seal 130 to pump and/or advance the core barrel assembly 110 within and along the drill string 104 until the core barrel assembly 110 reaches a desired position (for instance, a position at which the core barrel assembly 110 can be connected to the outer tube 112 as discussed above).

In operation, it is contemplated that the pressurized fluid pumped into the drill string 104 can build up behind the core barrel assembly 110 during retrieval (when the valve is in an open position) as described further herein. It is further contemplated that the build-up of the pressurized fluid will not occur during pump-in of the core barrel assembly 110 (when the valve is in a closed position) as described further herein. In inclined holes, it is contemplated that the application of pressurized fluid during retraction of the core barrel assembly 110 can prevent application of a braking mechanism (as described further herein) by lifting the weight and spring force off of the braking mechanism. In exemplary aspects, it is contemplated that the bushing 600 described further herein and depicted in FIGS. 10-14 can allow the valve element described herein to remain closed during retraction of the core barrel assembly such that fluid pressure can be maintained. It is further contemplated that the bushing 600 can be applied to a core barrel assembly 110 as described herein without a braking mechanism, thereby permitting application of fluid pressure to remove weight and spring force from any latching mechanism, ensuring a substantially load-free un-latching process, and preventing build-up of pressurized fluid.

In one or more implementations, the core barrel assembly 110 can further include a braking mechanism 132. The braking mechanism 132 can help prevent unintended expulsion of the core barrel assembly 110 from the drill string 104. Thus, the braking mechanism 132 can allow wireline retrieval systems to be used in up-hole drilling operations without the danger of the core barrel assembly 110 sliding out of the drill string 104 in an uncontrolled and possibly unsafe manner. Accordingly, the braking mechanism 132 can resist unintended removal or expulsion of the core barrel assembly 110 from the borehole by deploying the braking elements into a frictional arrangement between an inner wall of the casing or drill string 104 (or borehole).

Figure 2:
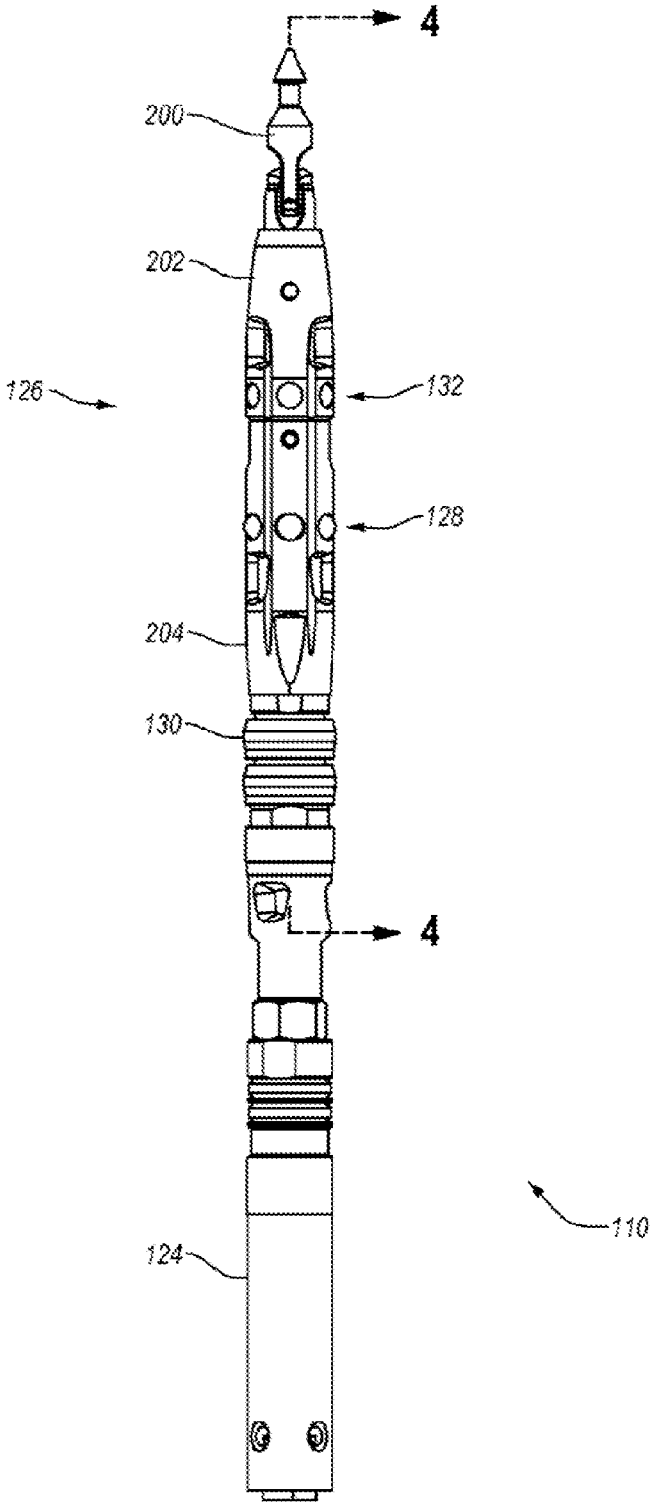
FIG. 2 illustrates an enlarged view of the core barrel assembly of FIG. 1, further illustrating a head assembly and a core barrel.

FIG. 2 illustrates the core barrel assembly 110 in greater detail. As previously mentioned, the core barrel assembly 110 can include a head assembly 126 and a core barrel 124. The head assembly 126 can include a spear head assembly 200 adapted to couple with an overshot, which in turn can be attached to a wireline. Furthermore, the head assembly 126 can include a first member 202 that can house the braking mechanism 132, and a sleeve 204 that can house the driven latch mechanism 128.

Figure 3:
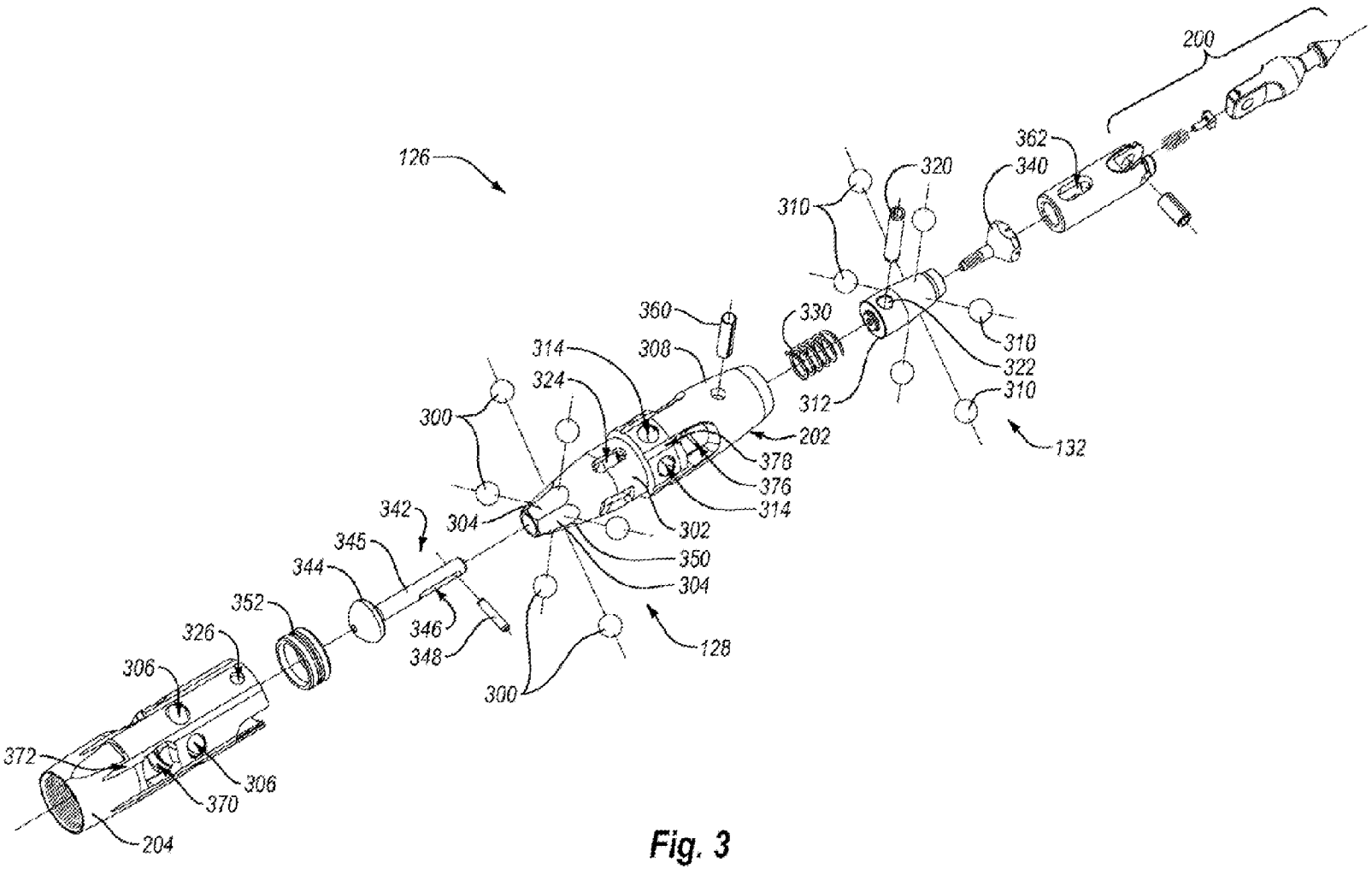
FIG. 3 illustrates an exploded view of the head assembly of FIG. 2.
Figure 4:
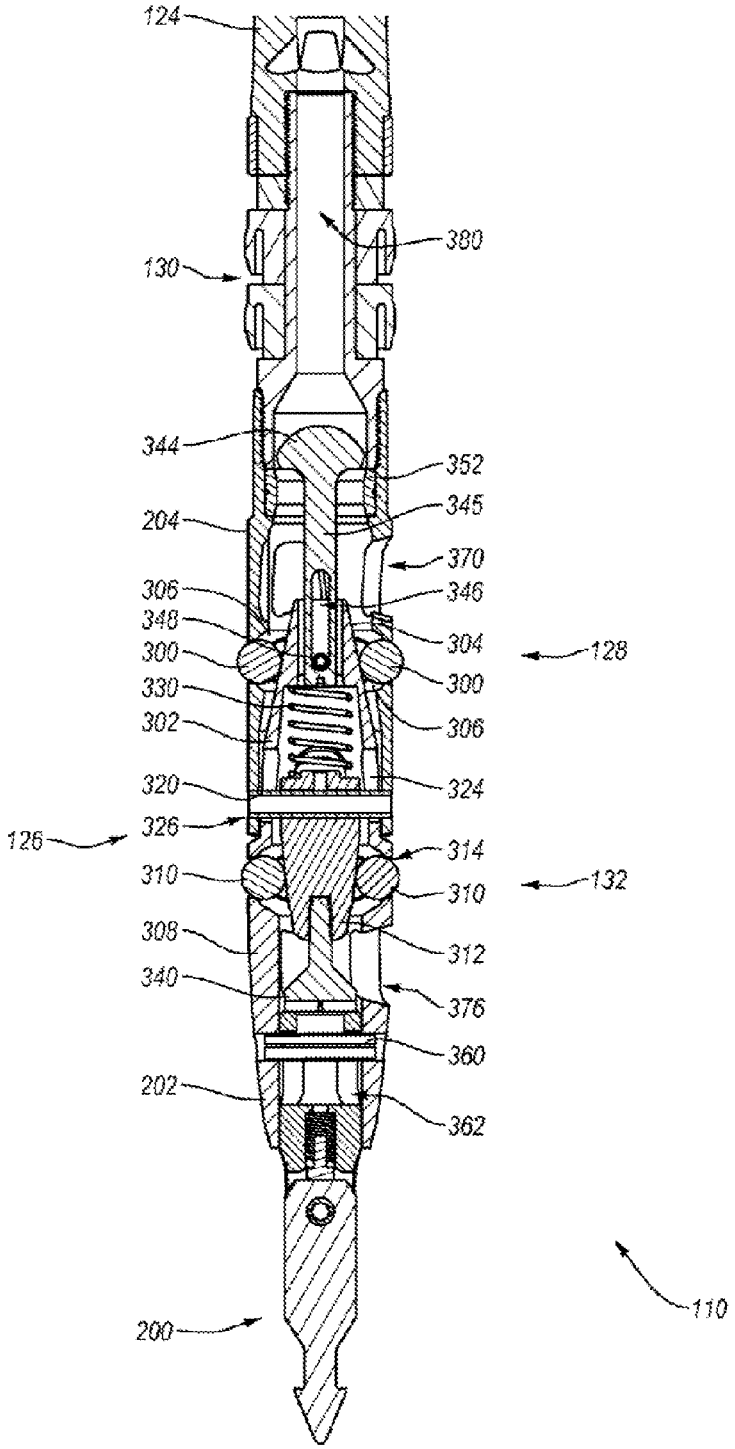
FIG. 4 illustrates a cross-sectional view of the core barrel assembly of FIG. 2 taken along the line 4-4 of FIG. 2.

FIGS. 3 and 4 and the corresponding text, illustrate or describe a number of components, details, and features of the core barrel assembly 110 shown in FIGS. 1 and 2. In particular, FIG. 3 illustrates an exploded view of the head assembly 126. While FIG. 4 illustrates a side, cross-sectional view of the core barrel assembly 110 taken along the line 4-4 of FIG. 2. FIG. 4 illustrates the driven latch mechanism 128 and the braking mechanism 132 in a fully deployed state. As shown by FIGS. 3 and 4, the driven latch mechanism 128 can include a plurality of wedge members 300. In one or more implementations, the wedge members 300 can comprise a spherical shape or be roller balls, as shown in FIGS. 3 and 4. The wedge members 300 may be made of steel, or other iron alloys, titanium and titanium alloys, compounds using aramid fibers, lubrication impregnated nylons or plastics, combinations thereof, or other suitable materials.

The wedge members 300 can be positioned on or against a driving member 302. More particularly, the wedge members 300 can be positioned on generally planar or flat driving surfaces 304. As explained in greater detail below, the generally planar configuration of the driving surfaces 304 can allow the wedge members 300 to be wedged between the driving member 302 and the inner diameter of a drill string to rotationally lock the core barrel assembly 110 to the drill string.

Figure 5:
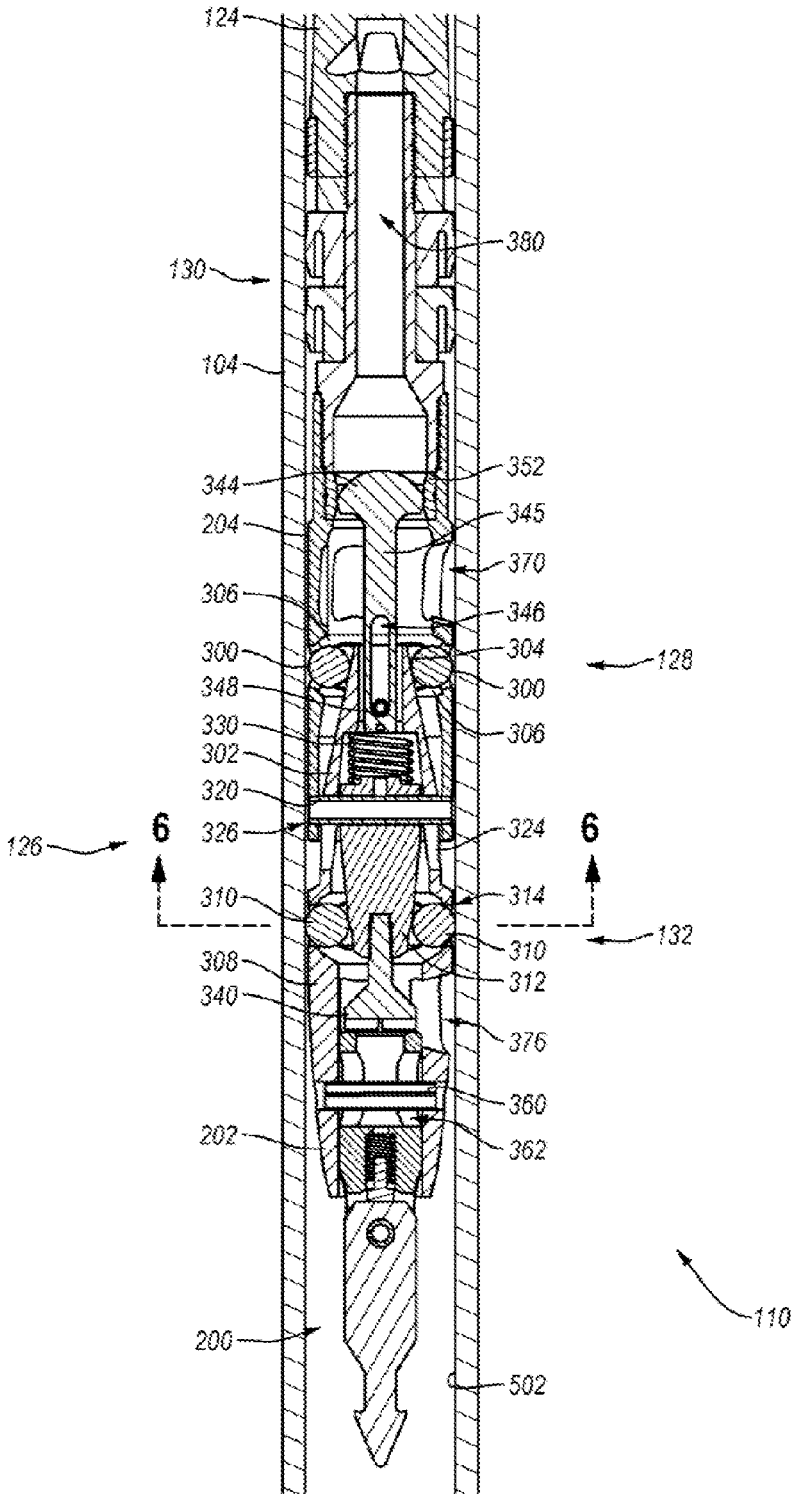
FIG. 5 illustrates a cross-sectional view of the core barrel assembly of FIG. 2 similar to FIG. 4, albeit with the driven latch mechanism in position for pumping the core barrel assembly within a drill string.
Figure 7:
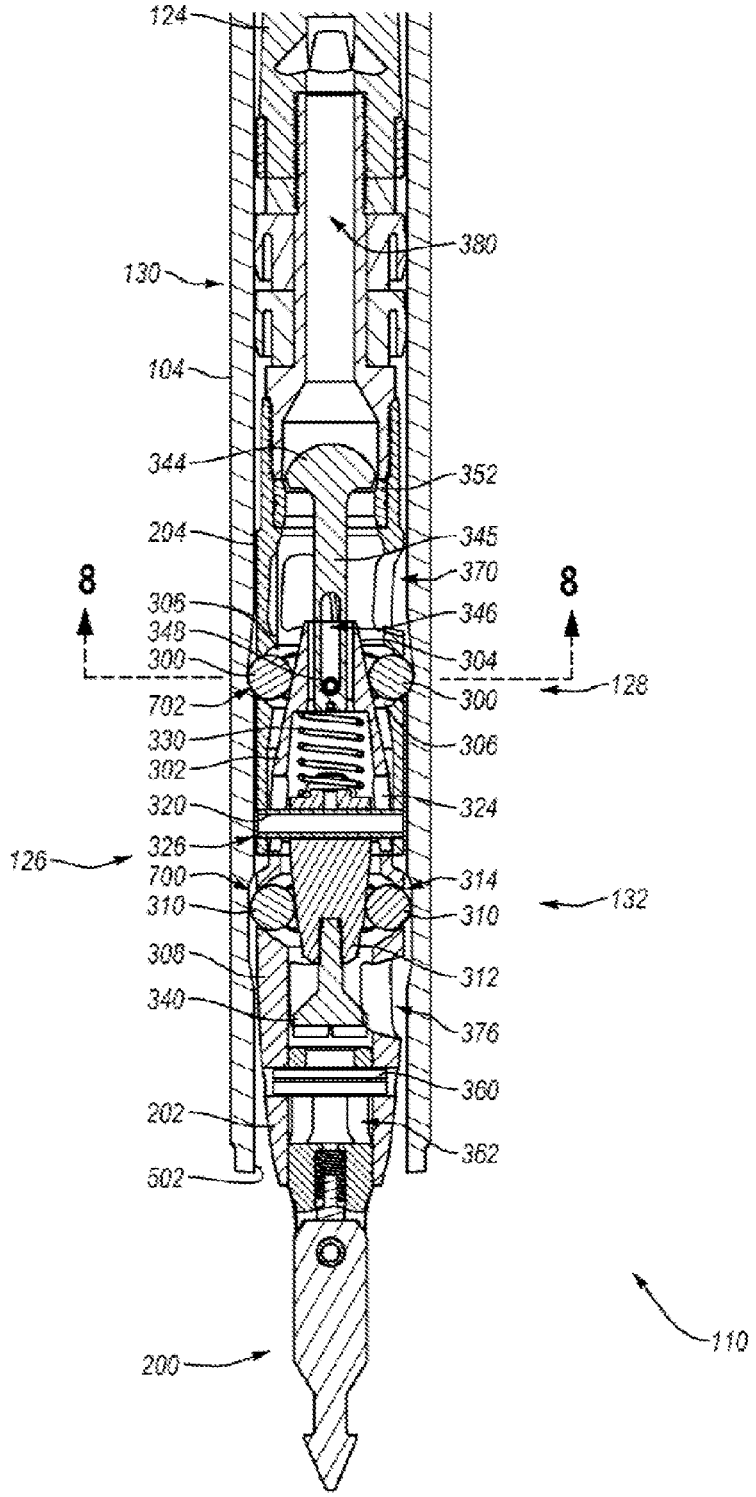
FIG. 7 illustrates a cross-sectional view of the core barrel assembly similar to FIG. 4, albeit with the driven latch mechanism latched to the drill string.

FIGS. 3 and 4 further illustrate that the wedge members 300 can extend through latch openings 306 extending through the generally hollow sleeve 204. The latch openings 306 can help hold or maintain the wedge members 300 in contact with the driving surfaces 304, which in turn can ensure that axial movement of the driving member 302 relative to the sleeve 204 results in radial displacement of the wedge members 300. As explained in greater detail below, as the driving member 302 moves axially toward or farther into the sleeve 204, the driving surfaces 304 can force the wedge members 300 radially outward of the sleeve 204 to a deployed or latched position (FIG. 7). Along similar lines, as the driving member 302 moves axially away from, or out of the sleeve 204, the wedge members 300 can radially retract at least partially into the sleeve 204 into a released position (FIG. 5).

In one or more implementations, the driving member 302, and more particularly the planar driving surfaces 304 can have a taper, as shown in FIGS. 3 and 4. The taper can allow the driving member 302 to force the wedge balls 300 radially outward as the driving member 302 moves axially closer to, or within, the sleeve 204. Also, the taper of the driving member 302 can allow the wedge members 300 to radially retract at least partially into the sleeve 204 when the driving member 302 moves axially away from the sleeve 204. One will appreciate that the driving member 302 (and driving surfaces 304) need not be tapered. For example, in alternative implementations, the driving member 302 can include a first portion have a smaller diameter, a transition portion, and a second portion with a larger diameter. In other words, the driving member 302 can include a step between a smaller diameter and a larger diameter instead of a taper along its length. The smaller diameter portion of the driving member 302 of such implementations can allow the wedge balls 300 to retract at least partially into the sleeve 204, and the larger diameter of the driving member 302 can force the wedge balls 300 radially outward in order to lock or latch to the drill string.

FIGS. 3 and 4 further illustrate that in addition to the driving member 302, the first member 202 can include an upper latch body 308. The upper latch body 308 can be generally hollow and can house the braking mechanism 132. As shown by FIGS. 3 and 4, the braking mechanism 132 can include a plurality of braking elements 310. In one or more implementations, the braking elements 310 can comprise a spherical shape or be roller balls, as shown in FIGS. 3 and 4. In other examples, the braking elements 310 may be flat, may have a cylindrical shape, or may have a wedge shape, to increase the braking surface area of the braking elements 310 against a casing and/or a conical surface. In other embodiments, the braking elements 310 may be of any shape and design desired to accomplish any desired braking characteristics.

The braking elements 310 may be made of any material suitable for being used as a compressive friction braking element. For example, the braking elements 310 may be made of steel, or other iron alloys, titanium and titanium alloys, compounds using aramid fibers, lubrication impregnated nylons or plastics, or combinations thereof. The material used for any braking element 310 can be the same or different than any other braking element 310.

The braking elements 310 can be positioned on a landing member 312. More particularly, the braking elements 310 can be positioned on generally conical or tapered landing member 312. As explained in greater detail below, the generally conical or tapered shape of the landing member 312 can allow the braking elements 310 to engage or maintain contact with an inner diameter of a drill rod that varies along its length. For example, some drill rods or casing have a first smaller inner diameter at their ends (near couplings) and a larger inner diameter near the their center. The larger inner diameter can allow for increase fluid flow around a core barrel assembly, and thus, faster tripping in and tripping out of a core barrel assembly. The tapered or conical configuration of the landing member 312 can allow axial translation of the landing member 312 to result in radial displacement of the braking elements 310, which in turn allow the braking elements 310 to move in and out of contact with the inner surface of an associated drill rod to prevent unintended or unwanted expulsion, as will be discussed in more detail below.

FIGS. 3 and 4 further illustrate that the braking elements 310 can extend through brake openings 314 extending through the generally first member 308. The brake openings 314 can help hold or maintain the braking elements 310 in contact with the tapered surface of the landing member 312, which in turn can ensure that axial movement of the landing member 312 relative to the upper latch body 308 results in radial displacement of the braking elements 310. As explained in greater detail below, as the landing member 312 moves axially out of or away from the upper latch body 308, the tapered surface(s) of the landing member 312 can force the braking elements 310 radially outward of the upper latch body 308 to an extended position. Along similar lines, as the landing member 312 moves axially toward or farther into the upper latch body 308, the braking elements 310 can radially retract at least partially into the upper latch body 308 into a retracted position.

One will appreciate that the sleeve 204, first member 202, and landing member 312 can all be coupled together. In particular, as shown by FIGS. 3 and 4, in at least one implementation a first pin 320 can extend through a mounting channel 322 in the landing member 312. The first pin 320 can then extend through mounting slots 324 of the first member 202 (and more particularly the driving member 302). From the mounting slots 324, the first pin 320 can extend into mounting holes 326 in the sleeve 204. Thus, the landing member 312 and the sleeve 204 can be axially fixed relative to each other. On the other hand, the mounting slots 324 can allow the landing member 312 and the sleeve 204 to move axially relative to the first member 202 or vice versa. Axial movement between the first member 202 and the sleeve 204 can cause the driving surfaces 304 to move the wedge members 300 radially outward and inward. While axial movement between the landing member 312 and the first member 202 can cause the landing member 312 to move the braking elements 310 radially outward and inward.

FIGS. 3 and 4 further illustrate that the head assembly 126 can include a biasing member 330. The biasing member 330 can bias the landing member 312 axially away from the driving member 302. The biasing of the landing member 312 away from the driving member 302 can tend to force the landing member 312 against the braking elements 310, thereby biasing the braking elements 310 radially outward. Similarly, in one or more implementations, the biasing member 330 can bias the driving member 302 against the wedge members 300, thereby biasing the wedge members 300 radially outward. The biasing member 330 can comprise a mechanical (e.g., spring), magnetic, or other mechanism configured to bias the landing member 312 axially away from the driving member 302. For example, FIGS. 3 and 4 illustrate that the biasing member 330 can comprise a coil spring.

The head assembly 126 can further include a brake head 340. The brake head 340 can be coupled to the landing member 312. In one or more implementations, the brake head 340 can comprise a stop configured to prevent the brake elements 310 from leaving the tapered surface of the landing member 312.

Still further, FIGS. 3 and 4 illustrate that the head assembly 126 can include a fluid control member 342. The fluid control member 342 can include a piston 344 and a shaft 345. The shaft 345 can include a channel 346 defined therein. A piston pin 348 can extend within the channel 346 and be coupled to pin holes 350 within the first member 202 (and particularly the driving member 302). The channel 346 can thus allow the piston 344 to move axially relative to the driving member 302. In particular, as explained in greater detail below, piston can move axially relative to the first member 202 in and out of engagement with a seal or bushing 352 forming a valve. The interaction of the fluid control member 342 will be discussed in more detail hereinafter.

In conjunction with the fluid control member 342 and seal 130, the core barrel assembly 110 can include various additional features to aid in pumping the core barrel assembly 110 down a drill string 104. In particular, the sleeve 204 can include one or more fluid ports 370 extending through the sleeve 204. Additionally, the sleeve 204 can include one or more axial grooves 372 extending at least partially along the length thereof. Similarly, first member 202 can include one or more fluid ports 376 extending through the first member 202. Furthermore, the first member 202 can include one or more axial grooves 378 extending at least partially along the length thereof.

One will appreciate in light of the disclosure herein that the fluid ports 372, 376 can allow fluid to flow from the outside diameter of the head assembly 126 into the center or bore of the head assembly 126. The axial grooves 378 on the other hand can allow fluid to flow axially along the head assembly 126 between the outer diameter of the head assembly 126 and the inner diameter of a drill string 104. In addition to the fluid ports and axial grooves, the core barrel assembly 110 can include a central bore 380 that can allow fluid to flow internally through the core barrel assembly 110, past the seals 130.

As previously mentioned, the head assembly 126 can include a spearhead assembly 200. The spear head assembly 200 can be coupled to the first member 202 via a spearhead pin 360. The spearhead pin 360 can extend within a mounting channel 362 in the spearhead assembly 200, thereby allowing the spearhead assembly 200 to move axially relative to the first member 202.

Referring now to FIGS. 5-9 operation of the core barrel assembly 110, driven latch mechanism 128, and braking mechanism 132 will now be described in greater detail. As previously mentioned, in one or more implementations of the present invention the core barrel assembly 110 can be pumped into a drill string 104 using hydraulic pressure. For example, FIG. 5 illustrates the core barrel assembly 110 as it is tripped into or down a drill string 104.

Specifically, FIG. 5 illustrates that the piston 344 is positioned against the bushing 352, thereby sealing off the central bore 380. Furthermore, the seal 130 seals the core barrel assembly 110 to the drill string 104. Thus, in the pump-in configuration shown by FIG. 5, fluid cannot pass through past the bushing 352 and piston 344 through the central bore 380 or past the seal 130 between in an annulus between the core drill barrel assembly 110 and the inner diameter 502 of the drill string 104. As such, as fluid is pumped into the drill string 344, the hydraulic pressure acts on the core barrel assembly 110 (piston 344 etc.) and pushes the core barrel assembly 110 down the drill string 104.

As the core barrel assembly 110 is pumped down the drill string 104, the pump-in force can act on the piston 344, causing the proximal end of the piston channel 346 to engage the piston pin 344. Thus, the pump in force can exert a distally directed force on the piston 344 and the first member 202 (as the first member 202 is secured to the piston pin 348). At the first member 202 is pushed distally by the pump in force, it can cause the braking elements 310 to ride distally along the tapered surface of the landing member 312. This is at least in part because the biasing member 330 exerts a proximal force on the landing member 312. The axial movement of the braking elements 310 (in the distal direction) relative to the tapered surface of the landing member 312 can force the braking elements radially outward until the braking elements 310 ride on the inner diameter 502 of the drill string 104 as shown by FIG. 5. Thus, the biasing member 330 can help retain the braking elements 310 in an extended position as the core barrel assembly 110 is pumped down the drill string 104.

With the braking elements 310 riding on the inner diameter 502 of the drill string 104, any further distal movement of the braking elements 310, piston pin 348, and piston 344 relative to the landing member 312 and sleeve 204 can be prevented. Thus, the piston 344 can be prevented from being pushed through the bushing 352 by the pump in force. Additionally, the driving member 302 can be prevented from moving axially in the distal direction relative to the sleeve 204, which can retain in a radially retracted portion. Maintaining the wedge members 300 at least partially retracted within the sleeve 204 can reduce friction between the drill string 104 and the latch mechanism 128, thereby increasing the speed with which the core barrel assembly 110 can be tripped down the drill string 104.

One will appreciate in light of the disclosure herein that the braking mechanism 132 can help prevent unintentional proximal movement of the core barrel assembly 110. For example, if proximal force were to act on the core barrel assembly 110 (such as gravity overcoming the pump in force due to a hydraulic problem), the landing member 312 can be urged proximally relative the braking elements 310 thereby forcing the braking elements 310 radially outward against the drill string 104 and braking or stopping proximal movement of the core barrel assembly 110. Thus, the braking mechanism 132 can act as a safety feature to prevent unintentional or undesired falling of the core barrel assembly 110.

Figure 6A:
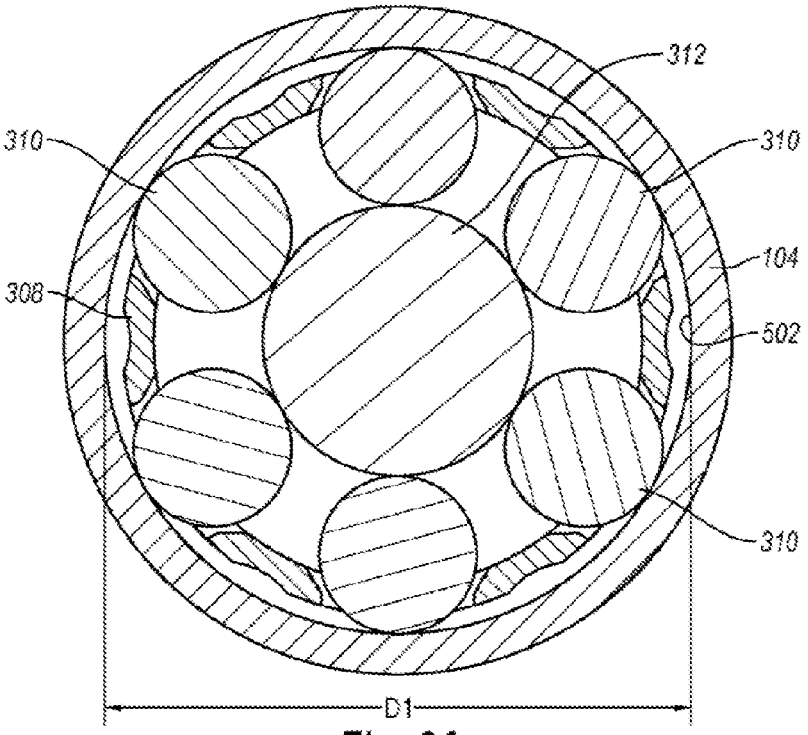
FIG. 6A illustrates a cross-sectional view of the core barely assembly of FIG. 5 taken along the line 6-6 of FIG. 5 in which a braking mechanism engages a drill rod having a first inner diameter.

Additionally, as previously mentioned, the braking mechanism 132 can allow for variation in the inner diameter of the drill string 104, such as that associate with quick decent casings and drill rods. In particular, FIG. 6A illustrates a cross-sectional view of the head assembly 126 taken along the line 6-6 of FIG. 5 (i.e., through the braking elements 310). As shown by FIG. 6A, the landing member 312 can force the braking elements 310 radially outward into contact with the inner diameter 502 of the drill string 104. In at least one implementation, the landing member 312 can have a generally circular cross-section as shown by FIG. 6A, this call allow the braking elements 310 to roll along the drill string 104 as the core barrel assembly 110 is pumped down the drill sting 104.

Figure 6B:
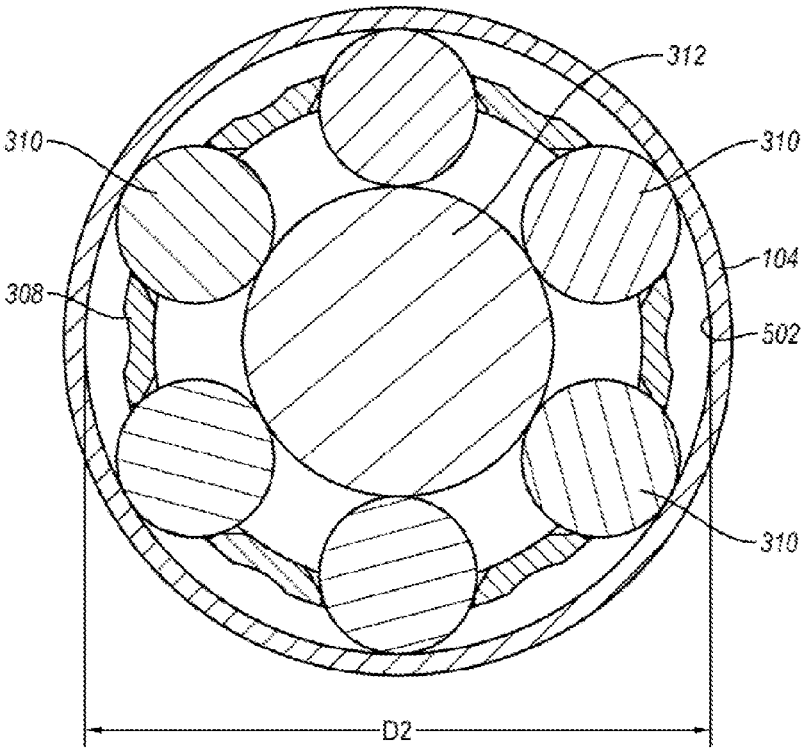
FIG. 6B illustrates a cross-sectional view of the core barely assembly of FIG. 5 similar to FIG. 6A, albeit with the braking mechanism engaging a drill rod having a diameter larger than the first diameter.

As previously mentioned, in one or more implementations, the landing member 312 can include a taper such that varying the diameter of the landing member 312 varies along its length. This in combination with the biasing member 330 can ensure that the barking elements 310 maintain engagement with the inner diameter of the drill string 104 even if it varies. For example, FIG. 6B illustrates a cross-sectional view similar to that of FIG. 6A albeit with the braking mechanism positioned at a point in the drill string 104 having an inner diameter D2 larger that the inner diameter D1 of the drill string 104 shown in FIG. 6A. As shown, despite the change in inner diameter 502 of the drill string 104, the landing member 312 can ensure that the braking elements 310 maintain engagement with the inner diameter 502 of the drill string 104.

Referring now to FIG. 7, once the in-hole assembly or core barrel assembly 110 has reached its desired location within the drill string 104; the distal end of the core barrel assembly 110 can pass through the last drill rod and land on a landing ring that sits on the top of the outer tube 112. At this point, the braking elements 310 can be axially aligned with a first annular groove 700 in the drill string 104. At this point the biasing member 330 can more fully deploy, pushing the landing member 312 proximally thereby pushing the braking elements 310 radially outward into the first annular groove 700.

Furthermore, once the core barrel assembly 110 has landed on the landing ring of the outer tube 112, the first member 202 can move distally toward (and in some implementations at least partially into) the sleeve 204. This movement can cause the driving surfaces 304 drive the wedge members 300 radially outward (through the latch openings 306) and into engagement with the inner diameter 104 of the drill string 104. In particular, the wedge members 300 can be driven into engagement with a second annular groove 702 formed in the inner surface 502 of the drill string 104.

With the wedge members 300 deployed in the second groove 702, the driven latch mechanism 128 can lock the core barrel assembly 110 axially in the drilling position. In other words, the wedge members 300 and the annular groove 702 can prevent axial movement of the core barrel assembly 110 relative to the outer tube 112. In particular, the driven latch mechanism 128 can withstand the drilling loads as a sample enters the core barrel 124. Additionally, the drive latch mechanism 128 can maintain a deployed or latched condition despite vibration and inertial loading of mating head assembly components, due to drilling operations or abnormal drill string movement.

One will appreciate that the when in the drilling position, the biasing member 330 can force the driving member 302 distally, thereby forcing the wedge members 300 radially outward into the deployed position. Thus, the driven latch mechanism 128 can help ensure that the wedge members 300 do not disengage or retract unintentionally such that the core barrel inner tube assembly rises from the drilling position in a down-angled hole, preventing drilling, or falls un-announced from an up-angled drill hole. At the same time, the biasing member 330 can force the landing member 312 proximately, thereby forcing the braking members 310 radially outward into the extended position.

In addition to the foregoing, FIG. 7 further illustrates that when in the drilling position, the piston 344 can pass distally beyond the bushing 352. This can allow fluid to flow within the central bore 380, past the seal 130. Thus, the fluid control member 342 can allow drilling fluid to reach the drill bit 106 to provide flushing and cooling as desired or needed during a drilling process. One will appreciate in light of the disclosure herein that a pressure spike can be created and then released as the core barrel reaches the drilling position and the piston 344 passes beyond the bushing 352. This pressure spike can provide an indication to a drill operator that the core barrel assembly 110 has reached the drilling position, and is latched to the drill string 104.

In addition to axially locking or latching the core barrel assembly 110 in a drilling position, the driven latch mechanism 128 can rotationally lock the core barrel assembly 110 relative to the drill string 104 such that the core barrel assembly 110 rotates in tandem with the drill string 104. As previously mentioned, this can prevent wear between the mating components of the core barrel assembly 110 and the drill string 104 (i.e., the wedge members 300, the braking elements 310, the inner diameter 502 of the drills string 104, landing shoulder at the distal end of the core barrel, landing ring at the proximal end of the outer tube 112).

Figure 8:
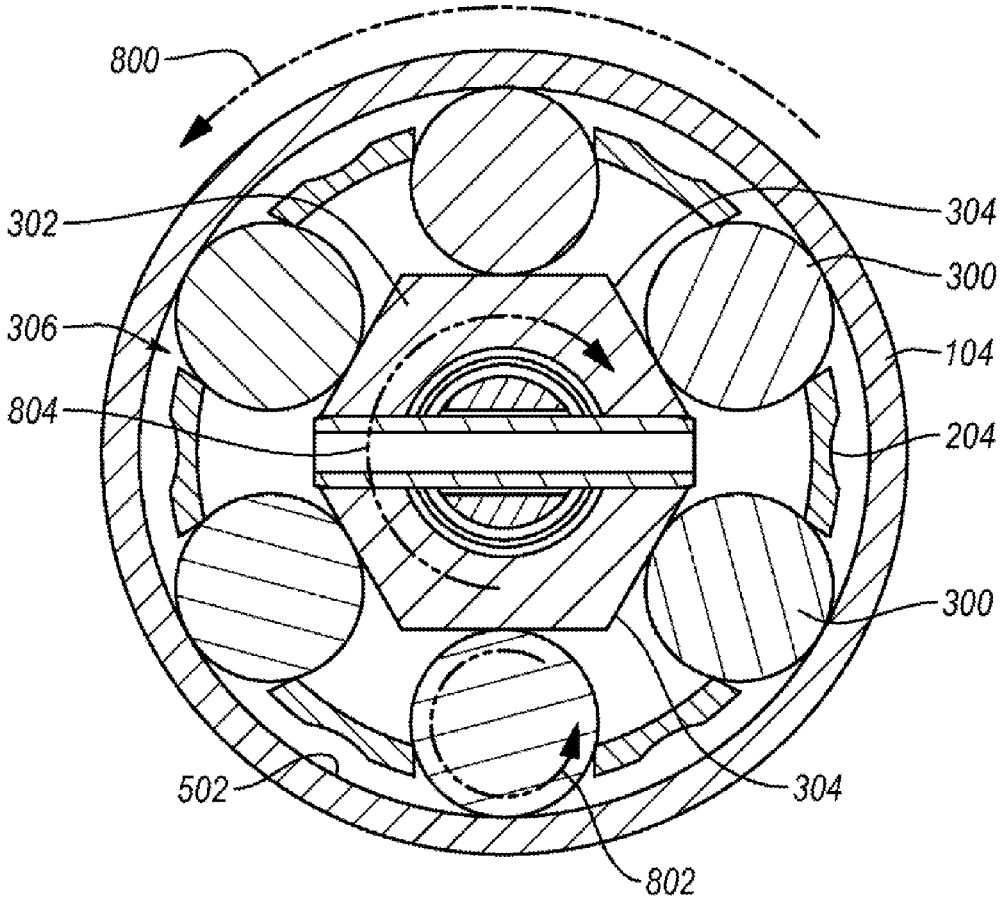
FIG. 8 illustrates a cross-sectional view of the core barrel assembly of FIG. 7 taken along the line 8-8 of FIG. 7.

In particular, referring to FIG. 8 as the drill string 104 rotates (indicated by arrow 800), the core barrel assembly 110 and the driving member 302 can have an inertia (indicated by arrow 804) that without out the driven latch mechanism 128 may tend to cause the core barrel assembly 110 not to rotate or rotate a slow rate then the drill string 104. As shown by FIG. 8, however, rotation of the drill string 104 causes the wedge members 300 to wedge in between the driving surfaces 304 of the driving member 302 and the inner diameter 502 of the drill string 104 as the rotation of the drill string 104 tries to rotate the wedge members 300 relative to the driving member 302 (indicated by arrow 802). The wedging or pinching of the wedge members 300 in between the driving surfaces 304 and the inner diameter 502 of the drill string 104 and rotationally lock the driving member 302 (and thus the core barrel assembly 110) relative to the drill string 104. Thus, the driven latch mechanism 128 can ensure that the core barrel assembly 110 rotates together with the drill string 104.

One will appreciate in light of the disclosure herein that configuration of the driving surfaces 304 and the inner diameter 502 of the drill string 104 can create a circumferential taper as shown by FIG. 8. In other words, the distance between the inner diameter 502 of the drill string 104 and the driving member 302 can vary circumferentially. This circumferential taper causes the wedge members 300 to wedge in between or become pinched between the drill string 104 and the driving member 302, thereby rotationally locking the core barrel assembly 110 to the drill string 104.

As shown by FIG. 8, in at least one implementation, the circumferential taper between the drill string 104 and the driving surfaces 104 can be created by the planar configuration of the driving surfaces 304. In alternative implementations, the driving surfaces 304 may not have a planar surface. For example, the driving surfaces 304 can have a concave, convex, rounded, v-shape, or other configuration as desired. In any event, one will appreciate that the configuration of the driving surfaces 304 can create a circumferential taper between the driving member 302 and the inner diameter 502 of the drill string 104. In yet further implementations, the driving member 302 can have a generally circular cross-section, and the inner diameter 502 of the drill string 104 can include a configuration to create a circumferential taper between the inner diameter 502 of the drill string 104 and the driving surfaces 304 or driving member 302.

One will appreciate in light of the disclosure herein that the braking mechanism 132 can act to prevent proximal acting forces from moving the core barrel assembly 110 out of the drilling position, thereby preventing unintended or unwanted expulsion. For example, during drilling a pressure pocket or other anomaly in the formation 102 may be encountered that creates a proximately directed force during the drilling process. Such a force could force the piston 344 and driving member 302 proximately, which could potentially release the driven latch mechanism 128 (i.e., cause the wedge members 300 to radially retract out of the annular groove 702). This in turn could allow the proximal force to potentially shoot the core barrel assembly proximally up the drill string 104, or blow out the core barrel assembly 110. The braking mechanism can prevent such an occurrence.

In particular, if a proximally acting or disturbance force, acts to move the first member proximately relative to the sleeve 204 it will force the landing member 312 proximately. This in turn can force the tapered surface(s) of the landing member 312 to drive the braking elements 310 radially outward through the brake openings 314 and into engagement with the associated drill rod. The engagement between the braking elements 310 and the drill string 104 can act to counter the proximally acting or disturbance force thereby braking or stopping the head assembly 126 and preventing unwanted or unintended expulsion. The braking mechanism 132 can deployed by a proximally acting force, while the driven latch mechanism 128 is deployed or retracted, and/or during pumping in or retracting of the core barrel assembly 110.

Figure 9:
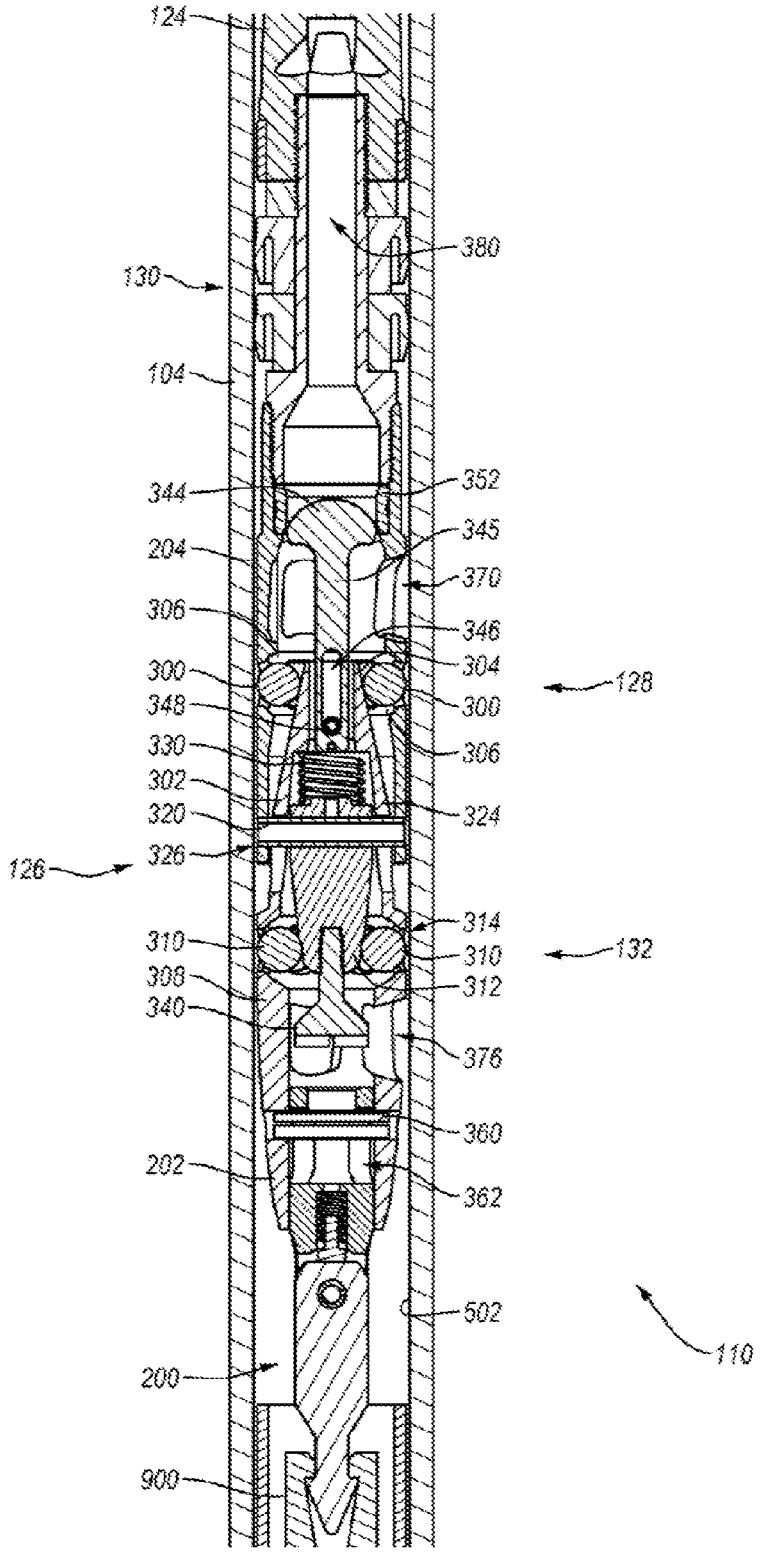
FIG. 9 illustrates a cross-sectional view of the core barrel assembly similar to FIG. 4, albeit with the driven latch mechanism in a released position allowing for retrieval of the core barrel assembly from the drill string.

At some point is may be desirable to retrieve the core barrel assembly 110, such as when a core sample has been captured. Referring to FIG. 9, in order to retrieve the core barrel assembly 110, a wireline 145 can be used to lower an overshot assembly 900 into engagement with the spearhead assembly 200. The wireline can then be used to pull the overshot 900 and spearhead assembly 200 proximally. This in turn can act to draw the first member 202 proximately away from the sleeve 204. Proximal movement of the first member 202 can cause the braking elements 310 to retract within the upper latch body 308, as they move along the landing member 312. Furthermore, proximal movement of the first member 202 can cause the wedge members 300 to radially retract as they move along the driving member 302. Once the first member 202 has been pulled proximately sufficiently to retract the braking mechanism 132 and the driven latch mechanism 128, the distal end of the mounting slots 324 can engage the pin 320, thereby pulling the sleeve 204 proximately.

As previously alluded to previously, numerous variations and alternative arrangements may be devised by those skilled in the art without departing from the spirit and scope of this description. For example, core barrel assembly in accordance with the present invention can include a conventional latching mechanism (such as spring-driven pivoting latches or mechanical link latches) to provide axial locking, and a driven latch mechanism to provide rotational locking For example, this could be done by modifying a head assembly component such as a lower latch body to include roller elements that engage the inner diameter of the landing ring which sits in the outer tube. In such a configuration, the lower latch body can include driving surfaces and a retainer member that allows the roller elements to become wedged between the driving surfaces and the outer tube, thereby rotationally locking the lower latch body to the inner diameter of the landing ring.

A Core Barrel Assembly Having an Up-Hole Bushing

Described herein with reference to FIGS. 10-14 is a bushing 600 for positioning within the core barrel assembly 110 during an up-hole drilling operation. It is contemplated that the bushing 600 can be used in place of bushing 352 when the core barrel assembly 110 is used to conduct up-hole drilling operations. As used herein, the term "up-hole drilling operation" refers to any drilling operation in which the drill string and core barrel assembly operate in a hole that is angled upwardly relative to a horizontal axis. Thus, any drilling operation in which the force of gravity works against the direction of drilling can be considered an "up-hole drilling operation."

Figure 10:
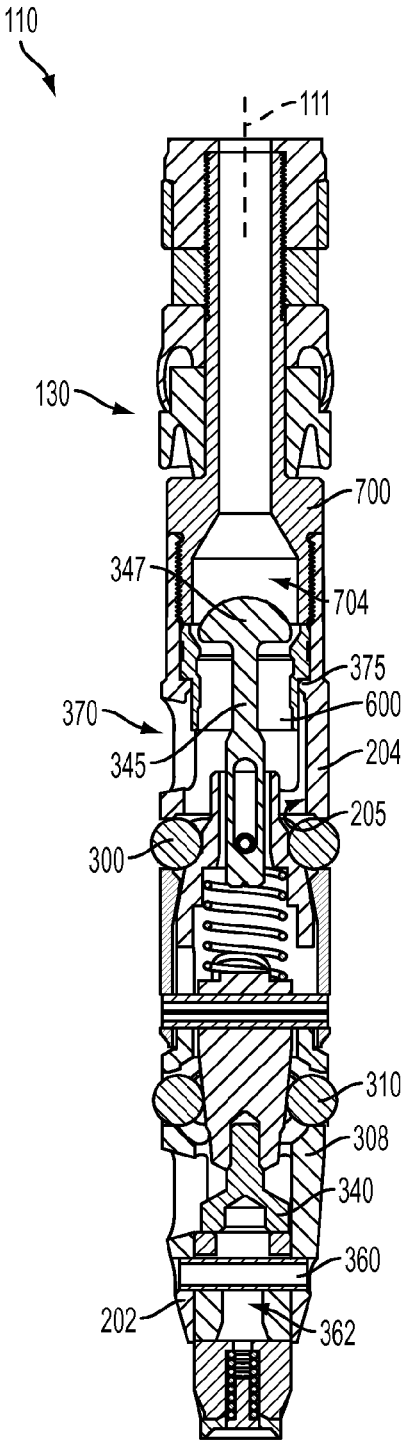
FIG. 10 illustrates a cross-sectional view of an exemplary core barrel assembly having an up-hole bushing as described herein. The driven latch mechanism of the core barrel assembly is shown in an extended/deployed position.
Figure 11:
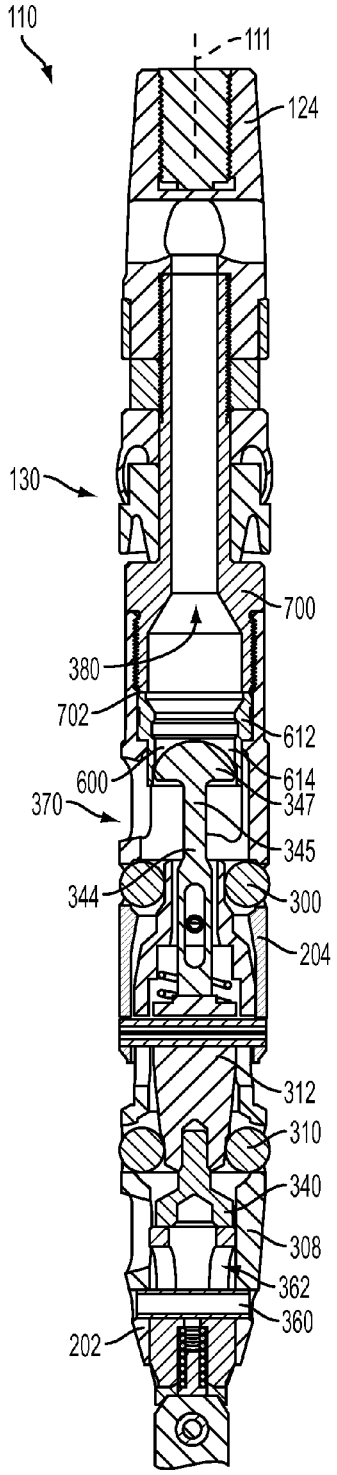
FIG. 11 is a cross-sectional view of the core barrel assembly of FIG. 10, with the driven latch mechanism in a retracted position.

In one aspect, the bushing 600 can have a longitudinal axis 620. As depicted in FIGS. 10-11, it is contemplated that the core barrel assembly 110 can have a longitudinal axis 111. In exemplary aspects, the longitudinal axis 620 of the bushing 600 can be substantially axially aligned with the longitudinal axis 111 of the core barrel assembly 110.

In exemplary aspects, the bushing 600 can comprise a wall 601 having an inner surface 602 and an outer surface 604. In these aspects, the inner surface 602 can define an inlet 606, an outlet 608, and a central bore 610 of the bushing 600. It is contemplated that the central bore 610 of the bushing 600 can surround the longitudinal axis 620 of the bushing and extend between the inlet 606 and the outlet 608 of the bushing.

In one aspect, the outer surface 604 of the bushing 600 can have a first portion 612 positioned proximate the inlet 606 of the bushing and a second portion 614 positioned proximate the outlet 608 of the bushing. In this aspect, it is contemplated that the first portion 612 of the outer surface 604 of the wall 601 can project outwardly from the second portion 614 of the outer surface relative to the longitudinal axis 620 of the bushing 600 such that the first portion of the outer surface defines opposed first and second shoulder surfaces 616, 618 extending substantially perpendicularly relative to the longitudinal axis of the bushing. Optionally, in another aspect, the first portion 612 of the outer surface 604 can define a slot 613 positioned between the first and second shoulder surfaces 616, 618 relative to the longitudinal axis 620 of the bushing 600. In this aspect, it is contemplated that the slot 613 can extend circumferentially about the first portion 612 of the outer surface 604 of the bushing 600. It is contemplated that the dimensions and aspect ratio of the slot 613 can be selectively varied to provide a reduction in the bushing resistance to the interference fit of the valve piston as the valve piston passes through the bushing. However, it is contemplated that the slot can be removed to provide the maximum resistance and as a result a significantly higher fluid pressure build up and greater available supply fluid pump capacity as to allow for deeper hole depths.

In exemplary aspects, and as previously described, it is contemplated that the bushing 600 can allow the valve element (e.g., the piston 344) to remain closed during retraction of the core barrel assembly 110 such that fluid pressure can be maintained. In these aspects, it is contemplated that the second portion 614 of the outer surface of the bushing 600 functions as an extension which permits the valve to remain closed during retraction of the core barrel assembly. It is further contemplated that the bushing 600 can be applied to a core barrel assembly 110 without a braking mechanism, thereby permitting application of fluid pressure to remove weight and spring force from any suitable latching mechanism, ensuring a substantially load-free unlatching process, and preventing build-up of pressurized fluid.

In exemplary aspects, and with reference to FIG. 14, the inner surface 602 of the bushing 600 can optionally define a projection 603 positioned between the inlet 606 and the outlet 608 of the bushing and extending into the central bore 610 of the bushing. In these aspects, the inlet 606 of the bushing 600 can define a first inner diameter of the bushing, and the projection 603 can define a second inner diameter of the bushing. It is contemplated that the first inner diameter of the bushing 600 can be greater than the second inner diameter of the bushing. It is further contemplated that the projection 603 can circumferentially surround the longitudinal axis 620 of the bushing 600. Optionally, in additional aspects, it is further contemplated that at least a portion of the inner surface 602 of the wall 601 of the bushing 600 between the inlet 606 and the projection 603 can be inwardly tapered relative to the longitudinal axis 620 of the bushing. It is contemplated that the inward taper can provide an angle transition to guide and gradually centralize the valve piston and to generate gradual changes in fluid pressures. In exemplary aspects, it is contemplated that a shallow angled taper can be employed to achieve this gradual change in pressure. In further optional aspects, the inner surface 602 of the wall 601 can define a recess 622 proximate the projection 603. In these aspects, the recess 622 can be positioned between the projection 603 and the outlet 608 of the bushing 600 relative to the longitudinal axis 620 of the bushing. It is contemplated that the recess 622 can be configured to receive at least a portion of the piston 344. It is further contemplated that the relative dimensions and angles of the recess 622 can be configured to achieve a different fit and pressure signal (upon engagement with the piston) when compared to the projection 603.

In other exemplary aspects, the sleeve 204 of the core barrel assembly 110 can have an inner surface 205 that defines an inner projection 375. In these aspects, it is contemplated that at least a portion of the outer surface 604 of the bushing 600 can be configured for engagement with the inner surface 205 of the sleeve 204. It is further contemplated that the second shoulder surface 618 of the bushing 600 can be configured for engagement with the inner projection 375 of the sleeve 204. It is still further contemplated that the inner projection 375 of the sleeve 204 can be positioned proximate a first fluid port of the at least one fluid port 370 such that the outlet 608 of the bushing 600 is in fluid communication with the first fluid port. In exemplary aspects, at least a portion of the second portion 614 of the outer surface 604 of the bushing 600 can overlap with a portion of at least one fluid port 370 relative to the longitudinal axis 111 of the core barrel assembly 110 such that a portion of the second portion of the outer surface of the bushing is substantially adjacent to an innermost portion of the fluid port.

In another aspect, the core barrel assembly 110 can comprise a lower latch body 700 removably coupled to the sleeve 204. In this aspect, it is contemplated that the first shoulder surface 616 of the bushing 600 can be configured for engagement with the lower latch body 700. It is further contemplated that the lower latch body 700 can have a first surface 702 that defines an outlet 704 in fluid communication with the inlet 606 of the bushing 600, with the outlet of the lower latch body being in communication with central bore 380.

In an additional aspect, the piston 344 can have an end portion 347 and an elongate shaft portion 345. In this aspect, the piston 344 can be configured for axial movement relative to the longitudinal axis 111 of the core barrel assembly 110. It is contemplated that the central bore 610 of the bushing 600 can be configured to receive at least a portion of the piston 344 such that axial movement of the piston relative to the longitudinal axis 620 of the core barrel head assembly 610 selectively controls fluid flow through the bushing. It is further contemplated that at least the end portion 347 of the piston 344 can remain within the central bore 610 of the bushing at all times.

In exemplary aspects, the piston 344 can be moveable about and between a blocking position and an open position. In these aspects, as depicted in FIG. 10, in the open position, the piston 344 can be positioned between the projection 603 of the bushing 600 and the inlet 602 of the bushing such that the piston is disengaged from the inner surface 602 of the bushing. As depicted in FIG. 11, in the blocking position, the end portion 347 of the piston 344 can be configured for engagement with at least a portion of the inner surface 602 of the bushing 600. For example, it is contemplated that the end portion 347 of the piston 344 can be configured for engagement with the inner surface 602 of the bushing 600 between the projection 603 of the bushing and the outlet 608 of the bushing. In further aspects, it is contemplated that the recess 622 of the bushing 600 can be configured to receive at least the end portion 347 of the piston 344 when the piston is positioned in the blocking position. In these aspects, in order to move the piston 344 from the blocking position to the open position, an axial force sufficient to advance the end portion 347 of the piston out of the recess 622 and past the projection 603 must be applied. It is contemplated that the axial force must also be sufficient to overcome any water that is resting against the end portion 347 of the piston 344.

In exemplary aspects, the piston 344 can be operatively coupled to the driven latch mechanism 128 and the braking mechanism 132 such that the piston is positioned in the blocking position when the driven latch mechanism and the braking mechanism are in a retracted position (FIG. 11) and the piston is positioned in the open position when the driven latch mechanism and the braking mechanism are in a deployed and/or extended position (FIG. 10). Thus, when the core barrel assembly is advanced into a hole or removed from a hole, it is contemplated that the piston 344 can be positioned in the blocking position, and the driven latch mechanism 128 and the braking mechanism 132 can be positioned in the retracted position. It is further contemplated that, upon landing of the core barrel assembly in a drilling position, the piston 344 can be positioned in the open position, and the driven latch mechanism 128 and the braking mechanism 132 can be positioned in the deployed and/or extended position as described herein. It is contemplated that the positioning of the piston 344 in the open position (such as, for example, by passage of the end portion 347 of the piston through the projection 603 of the bushing 600) can cause a pressure drop as water begins draining through the central bore 610 of the bushing 600 and the at least one fluid port 370 of the sleeve 204. Thus, it is contemplated that the piston 344 can function as a landing indicator for the core barrel assembly 110.

In additional aspects, it is contemplated that the end portion 347 of the piston 344 and the outlet 608 of the bushing 600 can have respective diameters. In these aspects, it is contemplated that the diameter of the outlet 608 can be less than or equal to the diameter of the end portion 347 of the piston 344 such that the end portion of the piston is positioned within the bushing 600 in an interference fit. In additional aspects, the first inner diameter of the bushing 600 (defined by the inlet 606 of the bushing as described above) can be greater than the diameter of the end portion 347 of the piston. In still further aspects, the second inner diameter of the bushing 600 (defined by the projection 603 as described above) can be less than the diameter of the end portion 347 of the piston. In still further aspects, the elongate shaft portion 345 of the piston 344 can have a diameter that is less than the diameter of the end portion 347 of the piston. In exemplary aspects, the end portion 347 of the piston 600 can conform to the shape of the recess 622 and the projection 603 such that, when the end portion of the piston is positioned within the recess, the end portion of the piston cooperates with the projection to maintain a blocking position in which water cannot pass around the piston.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A valve assembly for positioning within a core barrel assembly during an up-hole drilling operation, the valve assembly comprising:

a bushing having a longitudinal axis and a wall, the wall having an inner surface and an outer surface, the inner surface defining an inlet, an outlet, and a central bore of the bushing, the central bore surrounding the longitudinal axis and extending between the inlet and the outlet of the bushing, the outer surface having a first portion positioned proximate the inlet of the bushing and a second portion positioned proximate the outlet of the bushing, wherein the first portion of the outer surface of the wall projects outwardly from the second portion of the outer surface relative to the longitudinal axis of the bushing such that the first portion of the outer surface defines opposed first and second shoulder surfaces extending substantially perpendicularly relative to the longitudinal axis, wherein the inner surface defines a projection positioned between the inlet and the outlet of the bushing within the central bore of the bushing, and wherein the outlet of the bushing has an inner diameter; and a piston moveable about and between a blocking position and an open position relative to the longitudinal axis of the bushing, wherein the piston has an end portion that remains within the central bore of the bushing as the piston moves about and between the blocking position and the open position, and wherein the end portion of the piston has a diameter greater than the inner diameter of the outlet of the bushing, wherein the inner surface of the wall of the bushing maintains the piston in the blocking position as the end portion of the piston moves axially between the projection of the bushing and the outlet of the bushing, and wherein, in the blocking position, the piston blocks fluid flow through the bushing.

2. The valve assembly of claim 1, wherein the first portion of the outer surface of the wall of the bushing defines a slot positioned between the first and second shoulder surfaces relative to the longitudinal axis of the bushing.

3. The valve assembly of claim 1, wherein the inlet of the bushing has an inner diameter, and wherein the projection has an inner diameter, the inner diameter of the inlet of the bushing being greater than the inner diameter of the projection of the bushing.

4. The valve assembly of claim 3, wherein at least a portion of the inner surface of the wall of the bushing between the inlet and the projection is inwardly tapered relative to the longitudinal axis of the bushing.

5. The valve assembly of claim 3, wherein the inner surface of the wall of the bushing defines a recess proximate the projection, the recess being positioned between the projection and the outlet of the bushing relative to the longitudinal axis of the bushing.

6. The valve assembly of claim 5, wherein the recess is configured to receive at least a portion of the end portion of the piston as the piston moves axially toward the inlet of the bushing, and wherein the end portion of the piston is configured to cooperate with the projection of the bushing to maintain the piston in the blocking position.

7. The valve assembly of claim 3, wherein the projection circumferentially surrounds the longitudinal axis of the bushing.

8. The valve assembly of claim 1, wherein, in the open position, the piston is positioned axially between the projection of the bushing and the inlet of the bushing and is disengaged from the inner surface of the bushing.

9. A core barrel assembly configured to be removably received within a drill string, the core barrel assembly having a longitudinal axis and comprising:

a sleeve defining at least one fluid port and having an inner surface, the inner surface of the sleeve having an inner projection;

a lower latch body removably coupled to the sleeve;

a bushing positioned within the sleeve, the bushing having an inner surface and an outer surface, the inner surface defining an inlet, an outlet, and a central bore of the bushing, the central bore surrounding the longitudinal axis of the core barrel assembly and extending between the inlet and the outlet of the bushing, the outer surface having a first portion positioned proximate the inlet of the bushing and a second portion positioned proximate the outlet of the bushing, wherein the first portion of the outer surface of the bushing projects outwardly from the second portion of the outer surface relative to the longitudinal axis of the bushing such that the first portion of the outer surface defines opposed first and second shoulder surfaces extending substantially perpendicularly relative to the longitudinal axis, wherein the inner surface defines a projection positioned between the inlet and the outlet of the bushing within the central bore of the bushing, and wherein the outlet of the bushing has an inner diameter; and a piston moveable about and between a blocking position and an open position relative to the longitudinal axis of the core barrel assembly, wherein the piston has an end portion that remains within the central bore of the bushing as the piston moves about and between the blocking position and the open position, and wherein the end portion of the piston has a diameter greater than the inner diameter of the outlet of the bushing, wherein at least a portion of the outer surface of the bushing is configured for engagement with the inner surface of the sleeve, wherein the first shoulder surface of the bushing is configured for engagement with the lower latch body, wherein the second shoulder surface of the bushing is configured for engagement with the inner projection of the sleeve, and wherein the inner surface of the bushing maintains the piston in the blocking position as the end portion of the piston moves axially between the projection of the bushing and the outlet of the bushing, and wherein, in the blocking position, the piston blocks fluid flow through the bushing.

10. The core barrel assembly of claim 9, wherein the lower latch body defines an outlet in communication with the inlet of the bushing.

11. The core barrel assembly of claim 9, wherein the inner projection of the sleeve is positioned proximate a first fluid port of the at least one fluid port such that the outlet of the bushing is in fluid communication with the first fluid port.

12. The core barrel assembly of claim 9, wherein, in the open position, the piston is positioned axially between the projection of the bushing and the inlet of the bushing and is disengaged from the inner surface of the bushing.

13. The core barrel assembly of claim 12, wherein the inlet of the bushing has an inner diameter, and wherein the projection of the bushing has an inner diameter, the inner diameter of the inlet of the bushing being greater than the inner diameter of the projection of the bushing.

14. The core barrel assembly of claim 13, wherein at least a portion of the inner surface of the bushing between the inlet and the projection of the bushing is inwardly tapered relative to the longitudinal axis of the core barrel assembly.

15. The core barrel assembly of claim 12, wherein the inner surface of the bushing defines a recess proximate the projection of the bushing, the recess being positioned between the projection of the bushing and the outlet of the bushing relative to the longitudinal axis of the core barrel assembly.

16. The core barrel assembly of claim 15, wherein the recess of the bushing is configured to receive at least the end portion of the piston as the piston moves axially toward the inlet of the bushing, and wherein the end portion of the piston is configured to cooperate with the projection of the bushing to maintain the piston in the blocking position.

17. The core barrel assembly of claim 12, wherein the projection of the bushing circumferentially surrounds the longitudinal axis of the core barrel assembly.

18. The core barrel assembly of claim 12, further comprising a driven latch mechanism configured for movement about and between a retracted position in which the driven latch mechanism is disengaged from the drill string and a deployed position in which the driven latch mechanism engages the drill string to prevent rotation of the core barrel assembly relative to the drill string, wherein the piston is operatively coupled to the driven latch mechanism such that the piston is positioned in the blocking position when the driven latch mechanism is in the retracted position.

19. The core barrel assembly of claim 9, wherein the first portion of the outer surface of the bushing defines a slot positioned between the first and second shoulder surfaces relative to the longitudinal axis of the core barrel assembly.

* * * * *